US006658221B2

(12) United States Patent
Hama et al.

(10) Patent No.: US 6,658,221 B2
(45) Date of Patent: Dec. 2, 2003

(54) METHOD OF AND APPARATUS FOR MEASURING QUANTITY OF TONER ON BELT-SHAPED IMAGE CARRIER

(75) Inventors: Takashi Hama, Nagano-ken (JP); Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/045,015

(22) Filed: Jan. 15, 2002

(65) Prior Publication Data

US 2002/0098004 A1 Jul. 25, 2002

(30) Foreign Application Priority Data

Jan. 19, 2001 (JP) ..... 2001-011936
Jan. 19, 2001 (JP) ..... 2001-011937
Jan. 19, 2001 (JP) ..... 2001-011938

(51) Int. Cl.[7] ..... G03G 15/00
(52) U.S. Cl. ..... 399/49; 399/60
(58) Field of Search ..... 399/38, 46, 49, 399/60, 162, 302, 308

(56) References Cited

U.S. PATENT DOCUMENTS 5,512,986 A * 4/1996 Toyomura et al. ..... 399/60
5,722,006 A 2/1998 Watanabe
5,790,930 A * 8/1998 Fuchiwaki ..... 399/302
5,991,558 A 11/1999 Emi et al.
6,188,418 B1 * 2/2001 Hata ..... 399/49 X
6,377,763 B2 * 4/2002 Sato ..... 399/49
6,427,062 B1 * 7/2002 Takeuchi ..... 399/49 X

FOREIGN PATENT DOCUMENTS

JP 08-184999 7/1996
JP 10-326031 12/1998
JP 11-258872 9/1999

* cited by examiner

*Primary Examiner*—Sandra Brase
(74) *Attorney, Agent, or Firm*—Sughrue Mion, PLLC

(57) ABSTRACT

A light emitting element irradiates light upon a surface area of an intermediate transfer belt which is wound around a roller, i.e., upon a wind area, and light receiving units receive light reflected at the wind area. Based on a signal outputted from a sensor, the quantity of toner is measured. In the wind area, the intermediate transfer belt does not flap in a direction which is approximately perpendicular to a direction in which the belt travels. This suppresses a change in distance (sensing distance) between the sensor and the intermediate transfer belt.

25 Claims, 19 Drawing Sheets

METHOD OF AND APPARATUS FOR MEASURING QUANTITY OF TONER ON BELT-SHAPED IMAGE CARRIER

BACKGROUND OF THE INVENTION

1. Field of the Invention

The present invention relates to a toner quantity measuring method and a toner quantity measuring apparatus which measure the quantity of toner adhering on a belt-shaped image carrier which is stretched across a plurality of rollers, and an image forming apparatus which comprises such a toner quantity measuring apparatus.

2. Description of the Related Art

Among image forming apparatuses of the electrophotographic type, such as a printer, a copier machine and a facsimile machine, are those which create a toner image on a belt-shaped image carrier. For example, in an apparatus which is described in Japanese Patent Application Unexamined Gazette No. H11-258872, four process units are disposed along a transfer belt (belt-shaped image carrier) which is stretched across two rollers. Each process unit creates a latent image on a photosensitive member, and the latent image is developed with toner to thereby form a toner image. The toner images thus formed by these process units have different toner colors from each other (yellow, cyan, magenta, black), and transferred onto the transfer belt so that they are laid one atop the other. A color image is created on the transfer belt in this manner.

Further, in this apparatus, for the purpose of forming an image with a stable density by means of adjustment of the image densities of toner images, toner images having predetermined patterns (patch images) are formed on the transfer belt and the densities of these patterns are measured with a density sensor. The density sensor comprises a light emitting element which irradiates light upon the transfer belt and a light receiving element which receives light which is reflected by the transfer belt. A controller for controlling the apparatus calculates the quantity of toner adhering to the transfer belt based on an output from the light receiving element and accordingly measures the image densities of toner images.

By the way, there has not been any particular attention paid so far to the position at which the density sensor is arranged, and as a result, a sensor output contains various types of noise components and the accuracy of measuring a toner quantity deteriorates. In the conventional apparatus described above, for instance, since the density sensor is disposed at a position which is relatively far from the rollers, there are following problems.

At a position far from the rollers as described above, the transfer belt flaps in a direction which is approximately perpendicular to a direction in which the belt travels. Therefore, a distance (hereinafter referred to as "a sensing distance") from the sensor to the transfer belt (belt-shaped image carrier) changes at random or in an instable manner, and a sensor output becomes instable because of the varying distance. This results in difficulty in conducting accurate measurement.

In addition, the transfer belt is stretched across the plurality of rollers and some rollers are eccentric to no small extent. Because of this, the transfer belt flaps even more as the eccentric rollers rotate, which makes a sensor output instable and accurate measurement difficult.

Further, the thickness of the transfer belt is not uniform all over the entire circumference of the transfer belt but may be uneven. This acts as one factor which changes the sensing distance.

Still further, the quantity of light which is reflected by the transfer belt is influenced not only by toner images formed on the transfer belt but by the condition of a surface of the transfer belt as well. Particularly when the condition of the surface of the transfer belt, e.g., the reflectance and the surface roughness, is not uniform, one can not ignore an influence by the surface condition.

SUMMARY OF THE INVENTION

A principal object of the present invention is to provide a toner quantity measuring apparatus and a toner quantity measuring method which allow to highly accurate measure the quantity of toner adhering to a belt-shaped image carrier in a structure that the belt-shaped image carrier is stretched across a plurality of rollers.

Another object of the present invention is to provide a surface condition detecting method which allows to precisely detect the condition of a surface of a belt-shaped image carrier such as a transfer belt and a photosensitive belt.

Yet another object of the present invention is to provide an image forming apparatus which forms an image with a stable density based on a result of measurement conducted with a toner quantity measuring apparatus or by a toner quantity measuring method.

The present invention is direct to an apparatus for and a method of measuring the quantity of toner adhering on a belt-shaped image carrier which is stretched across a plurality of rollers. The apparatus comprises: a sensor irradiates light upon the belt-shaped image carrier, and receives light reflected by the belt-shaped image carrier and outputs a signal which corresponds to the quantity of the received light; and toner quantity deriving means calculates the quantity of the toner adhering to the belt-shaped image carrier based on the output from the sensor.

The sensor comprises a light emitting element which irradiates light upon the belt-shaped image carrier. The light emitting element is positioned to face one of the plurality of rollers across the belt-shaped image carrier, and irradiates light upon a wind area, out of a surface area of the belt-shaped image carrier, in which the belt-shaped image carrier rests on a sensor-facing roller which is positioned to face the light emitting element.

The toner quantity deriving means samples an output signal from the sensor while the belt-shaped image carrier rotates and travels, calculates eccentric components of the roller based on a sampling output, removes the eccentric components from the sampling output and accordingly calculates a periodic profile which is indicative of the condition of a surface of the belt-shaped image carrier, and for calculation of the image density of a toner image on the belt-shaped image carrier, using the eccentric components and the periodic profile, the toner quantity deriving means corrects the output from the light receiving element which receives light reflected by the belt-shaped image carrier and calculates the image density of the toner image based on a correction value.

In the case that the length of the circumference of the belt-shaped image carrier is an integer multiple of the length of the circumference of one of the rollers, and the belt-shaped image carrier rotates one round while the one of the rollers rotates two or more rounds, before a toner image is formed on the belt-shaped image carrier, the toner quantity deriving means samples the output signal from the sensor while the belt-shaped image carrier rotates and travels and calculates eccentric components of the roller based on a sampling output. Thereafter, for calculation of the image density of the toner image on the belt-shaped image carrier, using the eccentric components, the toner quantity deriving means corrects the output from the sensor which receives light reflected by the belt-shaped image carrier and calculates the image density of the toner image based on a correction value.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
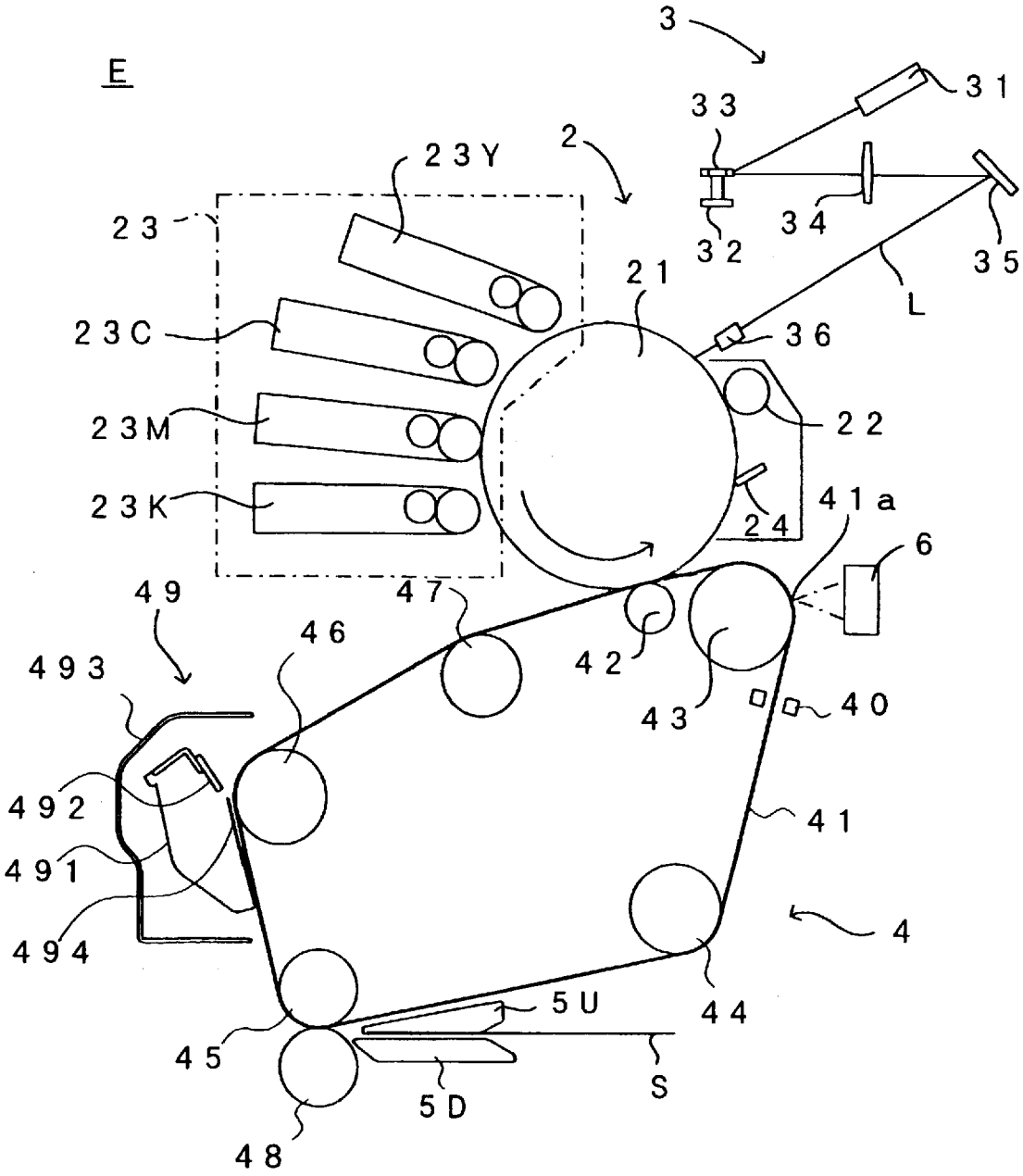
FIG. 1 is a drawing of a preferred embodiment of an image forming apparatus according to the present invention.

FIG. 1 is a drawing of a preferred embodiment of an image forming apparatus according to the present invention. This image forming apparatus is an apparatus which overlays toner images in four colors of yellow (Y), cyan (C), magenta (M) and black (K) one atop the other and creates a full-color image. As a control unit (denoted generally at 1 in FIG. 2) receives an image signal from an external apparatus such as a host computer, an image corresponding to the image signal is created on a sheet S, such as a transfer paper, a copier paper and a transparency for an overhead projector, with the respective portions of an engine part E operating under the control of the control unit.

In the engine part E, it is possible to form a toner image on a photosensitive member 21 of a process unit 2. In other words, the process unit 2 comprises the photosensitive member 21 which can rotate in the direction indicated by the arrow in FIG. 1. Further, an electrifying roller 22 serving as electrifying means, developers 23Y, 23C, 23M and 23K serving as developing means, and a cleaner blade 24 for photosensitive member are disposed around the photosensitive member 21 and along the direction of rotations of the photosensitive member 21.

In this apparatus, after the electrifying roller 22 uniformly electrifies an external circumferential surface of the photosensitive member 21 while staying in contact with the outer circumferential surface of the photosensitive member 21, an exposure unit 3 irradiates laser light L toward the outer circumferential surface of the photosensitive member 21. As shown in FIG. 1, the exposure unit 3 comprises a light emitting element 31 such as a semiconductor laser which is modulated as driven in response to the image signal, and laser light L from the light emitting element 31 is incident upon a polygon mirror 33 which is driven to rotate by a high-speed motor 32. The laser light L reflected by the polygon mirror 33 sweeps over the photosensitive member 21 in a main scanning direction (a direction which is perpendicular to the plane of the drawing) through a lens 34 and a mirror 35, whereby an electrostatic latent image which corresponds to the image signal is formed. Denoted at 36 is a horizontal synchronization reader sensor for obtaining a synchronizing signal in the main scanning direction.

The electrostatic latent image thus created is developed with toner by a developer part 23. In short, the developer 23Y for yellow, the developer 23C for cyan, the developer 23M for magenta and the developer 23K for black are arranged as the developer part 23 in this order along the photosensitive member 21, according to this embodiment. The developers 23Y, 23C, 23M and 23K are each capable of freely abutting on and departing from the photosensitive member 21. In response to an instruction from the control unit 1, one of the four developers 23Y, 23C, 23M and 23K selectively contacts the photosensitive member 21, supplies toner of a selected color to a surface of the photosensitive member 21 by means of an applied high voltage, and visualizes the electrostatic latent image on the photosensitive member 21.

The toner image developed by the developer part 23 is primarily transferred, in a primary transfer area located between the black developer 23K and the cleaner blade 24 for photosensitive member, onto an intermediate transfer belt 41 (belt-shaped image carrier) of a transfer unit 4. Further, the cleaner blade 24 for photosensitive member is disposed at a position ahead of the primary transfer area in a circumferential direction (which is the direction indicated at the arrow in FIG. 1), and scrapes off the toner still sticking to the outer circumferential surface of the photosensitive member 21 after the primary transfer.

The transfer unit 4 comprises seven rollers 42 to 48, and the endless intermediate transfer belt 41 is stretched across the six rollers 42 to 47 except for the secondary transfer roller 48. For transfer of a color image onto a sheet S, toner images of the respective colors formed on the photosensitive member 21 are laid one atop the other on the intermediate transfer belt 41 thereby forming a color image, during which the sheet S unloaded from a cassette or a hand-feed tray travels to a secondary transfer area moving passed between an upper guide member 5U and a lower guide member 5D, whereby the color image is secondarily transferred onto the sheet S and the color image is obtained (color printing process). Meanwhile, for transfer of a monochrome image onto a sheet S, only a black toner image on the photosensitive member 21 is formed on the intermediate transfer belt 41 and thereafter transferred onto a sheet S conveyed to the secondary transfer area in a manner similar to that for a color image, whereby the monochrome image is obtained (monochrome printing process).

A belt cleaner 49 is disposed facing the roller 46. The belt cleaner 49 is for removing and cleaning off residual toner which remain on the intermediate transfer belt 41 after the secondary transfer, and has a structure as described below. In short, in the belt cleaner 49, a cleaner blade 492 is attached to a cleaner case 491 in such a manner that the cleaner blade 492 can abut on and move away from the intermediate transfer belt 41 inside a cleaner cover 493, and the cleaner blade 492 is driven by a belt cleaner driver part (not shown) to abut on and move away from the intermediate transfer belt. Denoted at 494 in FIG. 1 is a cleaner scoop sheet.

A sensor 40 for detecting a reference position of the intermediate transfer belt 41 is disposed at a position below the roller 43, to serve as a vertical synchronization reader sensor for obtaining a synchronizing signal in a sub scanning direction which is approximately perpendicular to the main scanning direction, i.e., a vertical synchronizing signal. Meanwhile, a sensor 6 for detecting the quantity of toner adhering on the intermediate transfer belt 41 which is spun over the roller 43, is disposed so as to face the roller 43 across the intermediate transfer belt 41. Thus, the roller 43 in this embodiment is a "sensor-facing roller" of the present invention.

Figure 2:
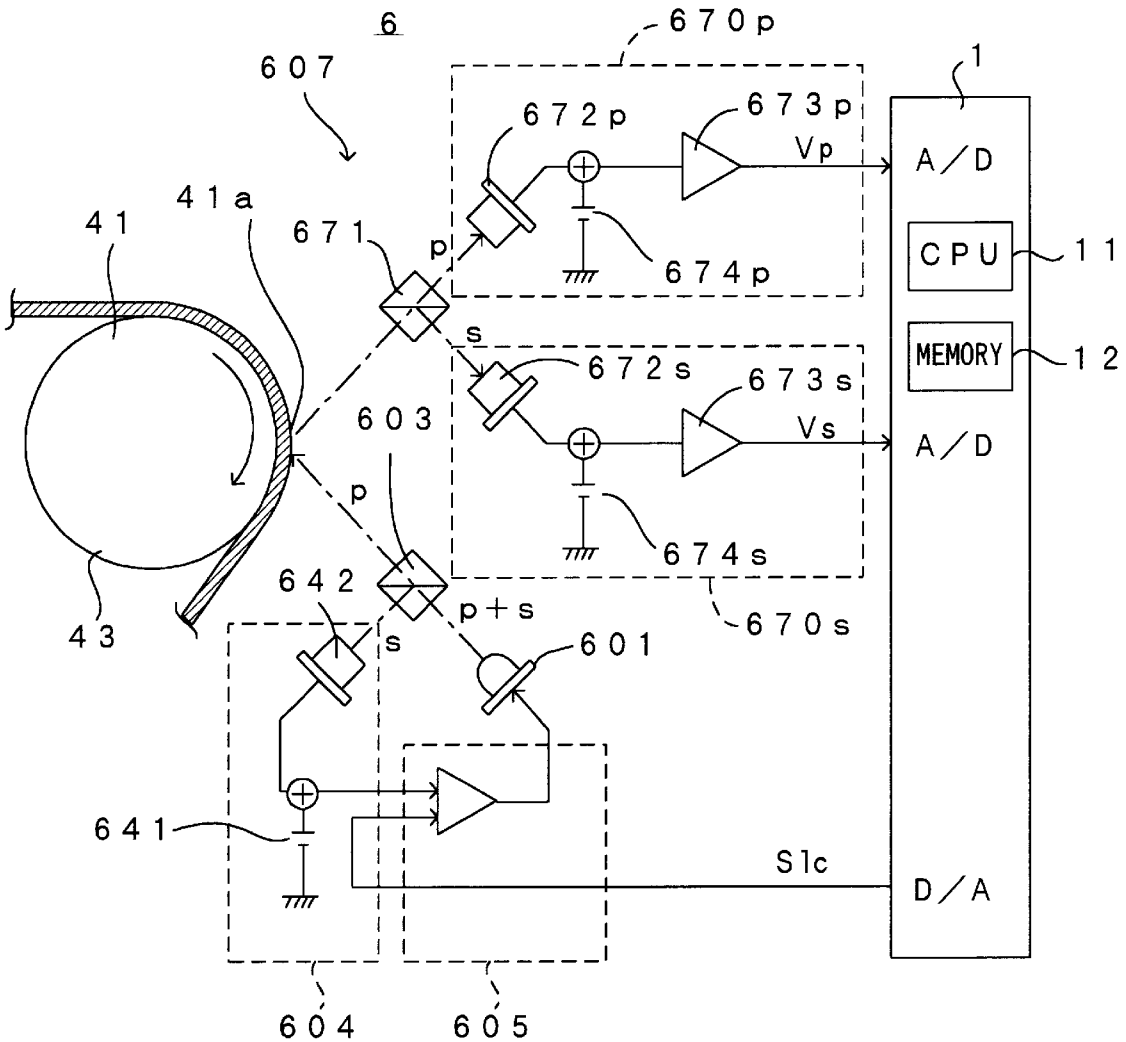
FIG. 2 is a drawing of a structure of a sensor which detects the quantity of toner which is on an intermediate transfer belt.

FIG. 2 is a drawing of a structure of the sensor which detects the quantity of toner on the intermediate transfer belt. This sensor 6 comprises a light emitting element 601 such as an LED which irradiates light upon a wind area 41*a* resting on the roller 43 out of a surface area of the intermediate transfer belt 41. Further, in order to adjust the quantity of irradiated light, the sensor 6 comprises a polarizing beam splitter 603, an irradiation quantity monitoring light receiving unit 604 and an irradiation quantity adjusting unit 605.

The polarizing beam splitter 603 is located between the light emitting element 601 and the intermediate transfer belt 41 as shown in FIG. 2, and splits light into p-polarized light whose polarization direction is parallel to a surface of incidence in which the irradiated light impinges on the intermediate transfer belt 41 and s-polarized light whose polarization direction is perpendicular to the surface of incidence. While the p-polarized light directly impinges upon the intermediate transfer belt 41, the s-polarized light enters the irradiation quantity monitoring light receiving unit 604 after leaving the polarizing beam splitter 603 so that a signal, which is in proportion to the quantity of the irradiated light from the light receiving unit 604, is outputted to the irradiation quantity adjusting unit 605.

Based on the signal from the light receiving unit 604 and a light quantity control signal S1c provided from the control unit 1 which comprises a CPU 11 and a memory 12 and controls the apparatus as a whole, the irradiation quantity adjusting unit 605 feedback-controls the light emitting element 601, whereby the quantity of the irradiated light from the light emitting element 601 illuminating the intermediate transfer belt 41 is adjusted to a value which corresponds to the light quantity control signal S1c. In this manner, this embodiment permits to change and adjust the quantity of irradiation in a wide range.

Figure 3:
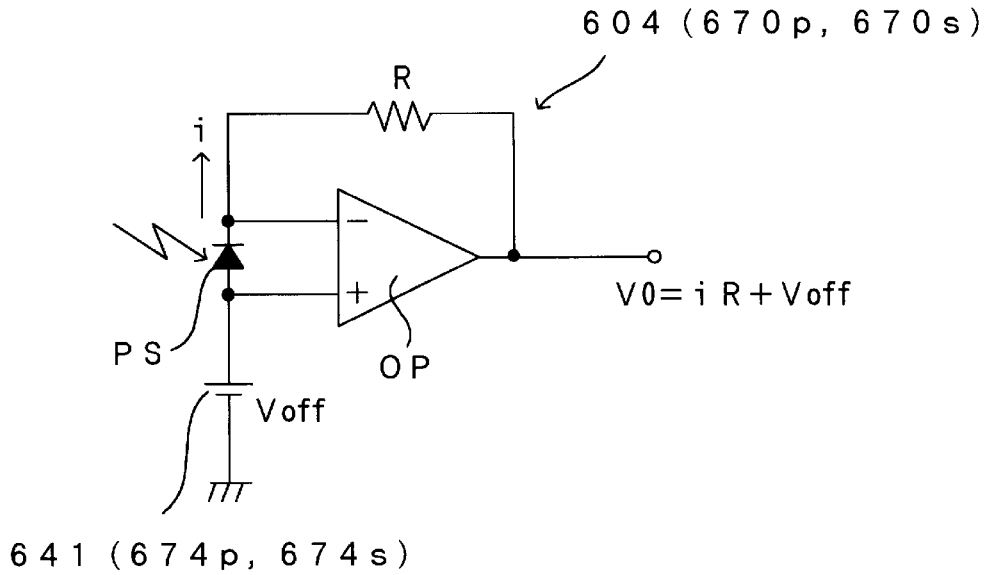
FIG. 3 is a drawing of an electric structure of a light receiving unit used in the apparatus shown in FIG. 1.

Further, according to this embodiment, an input offset voltage 641 is applied to the output side of a light receiving element 642 which is disposed to the irradiation quantity monitoring light receiving unit 604, and therefore, the light emitting element 601 is maintained turned off unless the light quantity control signal S1c exceeds a certain signal level. A specific electric structure of this is as shown in FIG. 3. FIG. 3 is a drawing of an electric structure of the light receiving unit 604 used in the apparatus shown in FIG. 1. In the light receiving unit 604, an anode terminal of a light receiving element PS such as a photodiode is connected with a non-inversion input terminal of an operational amplifier OP which forms a current/voltage (I/V) circuit and grounded through the input offset voltage 641. Meanwhile, a cathode terminal of the light receiving element PS is connected with an inversion input terminal of the operational amplifier OP and also with an output terminal of the operational amplifier OP through a resistor R. Hence, as the light receiving element PS receives light and carries a photoelectric current i, an output voltage V0 at the output terminal-of the operational amplifier OP is:

$$V0=i\cdot R+Voff$$

(where Voff denotes an offset voltage value) and therefore, a signal corresponding to the quantity of the reflected light is outputted from the light receiving unit 604. The reason of such a structure will be described in the following.

Figure 4:
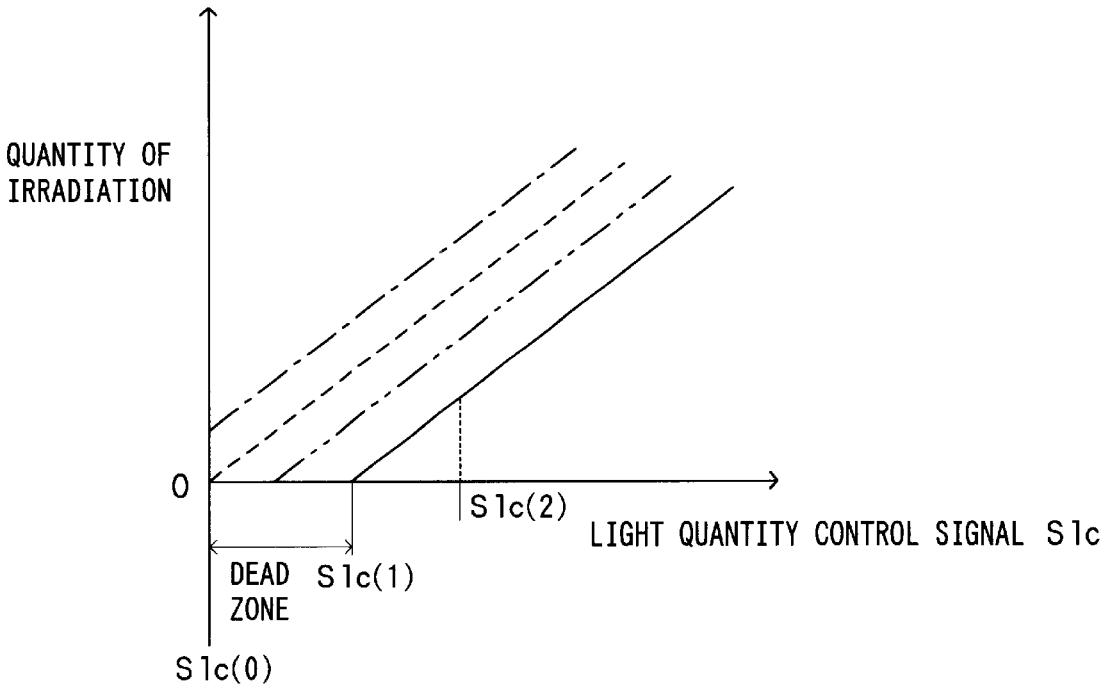
FIG. 4 is a drawing of a light quantity control characteristic in the apparatus shown in FIG. 1.

Without application of the input offset voltage 641, a light quantity characteristic is as indicated at the dotted line in FIG. 4. That is, as the light quantity control signal S1c(0) is supplied to the irradiation quantity adjusting unit 605 from the control unit 1, the light emitting element 601 turns off. The light emitting element 601 turns on when the signal level of the light quantity control signal S1c increases, and the quantity of the irradiated light upon the intermediate transfer belt 41 as well increases in approximate proportion to the signal level. However, the light quantity characteristic sometimes shifts parallel as indicated at the dotted-and-dashed line or the double-dotted-and-dashed line in FIG. 4 due to an influence of an ambient temperature, the structure of the irradiation quantity adjusting unit 605, etc. Once a shift as that denoted at the dotted-and-dashed line in FIG. 4 for instance occurs, the light emitting element 601 may stay turned on despite a turn-off instruction, namely, the light quantity control signal S1c(0) from the control unit 1.

In contrast, the embodiment has a dead zone. More specifically, a shift toward the right-hand side in FIG. 4 is provided in advance by means of application of the input offset voltage 641 and the dead zone (signal levels S1c(0) to S1c(1)) is consequently created as in this embodiment (as indicated at the solid line in FIG. 4). With the turn-off instruction, namely, the light quantity control signal S1c(0) supplied from the control unit 1, it is possible to turn off the light emitting element 601 without fail, and hence, prevent malfunction of the apparatus.

On the other hand, when the light quantity control signal S1c exceeding the signal level S1c(1) is supplied to the irradiation quantity adjusting unit 605 from the control unit 1, the light emitting element 601 turns on and p-polarized light is irradiated as irradiation light toward the intermediate transfer belt 41. The intermediate transfer belt 41 reflects the p-polarized light, a reflection quantity detecting unit 607 detects the quantities of the p-polarized light and the s-polarized light among light components of the reflected light, and signals corresponding to the respective light quantities are outputted to the control unit 1.

As shown in FIG. 2, the reflection quantity detecting unit 607 comprises a polarizing beam splitter 671 which is disposed on an optical path of the reflected light, a light receiving unit 670*p* which receives the p-polarized light traveling through the polarizing beam splitter 671 and outputs a signal corresponding to the quantity of the p-polarized light, and a light receiving unit 670*s* which receives the s-polarized light split by the polarizing beam splitter 671 and outputs a signal corresponding to the quantity of the s-polarized light. In the light receiving unit 670*p*, a light receiving element 672*p* receives the p-polarized light from the polarizing beam splitter 671, and after the output signal from the light receiving element 672*p* is amplified by an amplifier circuit 673*p*, the light receiving unit 670*p* outputs the amplified signal as a signal which corresponds to the quantity of the p-polarized light. Further, like the light receiving unit 670*p*, the light receiving unit 670*s* comprises a light receiving element 672*s* and an amplifier circuit 673*s*. Hence, it is possible to independently calculate the light quantities of two light components (i.e., the p-polarized light and the s-polarized light) which are different from each other among light components of the reflected light.

Figure 5:
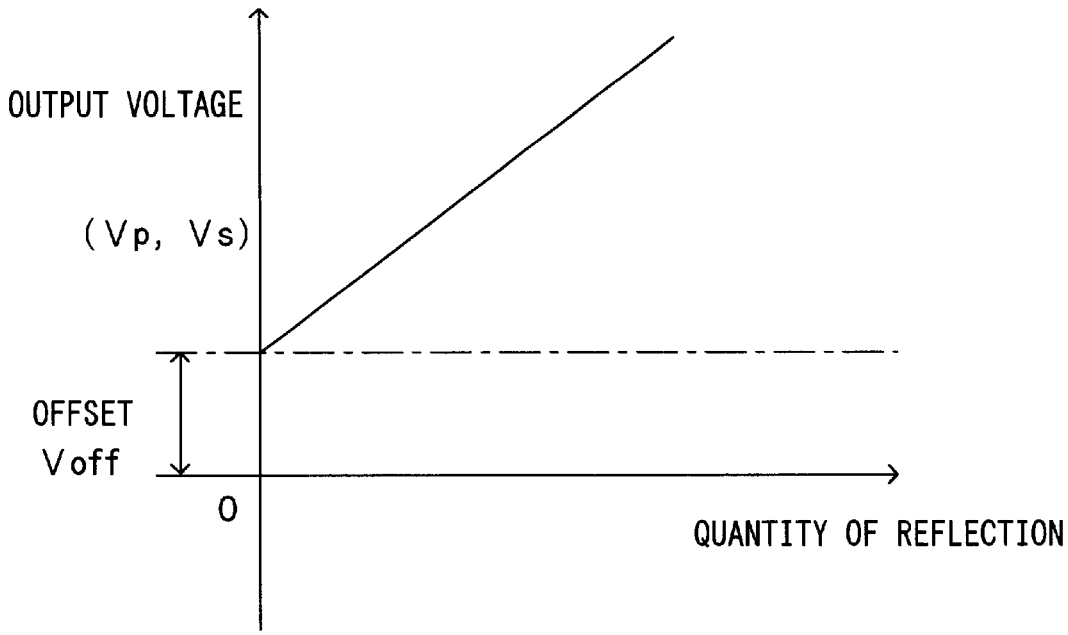
FIG. 5 is a graph showing a change in output voltage with respect to the quantity of reflected light in the apparatus shown in FIG. 1.

Further, in this embodiment, output offset voltages 674*p*, 674*s* are applied respectively to the output side of the light receiving elements 672*p*, 672*s*, and output voltages Vp, Vs of signals supplied to the control unit 1 from the amplifier circuits 673*p*, 673*s* are offset to the positive side as shown in FIG. 5. Specific electric structures of the respective light receiving units 670*p*, 670*s* are the same as that of the light receiving unit 604, and therefore, will not be shown in the drawings or described again. In the light receiving units 670*p*, 670*s* having such structures as well, the output voltages Vp, Vs each have a value which is equal to or larger than zero even when the quantity of the reflected light is zero, and moreover, the output voltages Vp, Vs increase proportionally as the quantity of the reflected light increases, which is similar as in the light receiving unit 604. In this manner, with application of output offset voltages 674*p*, 674*s*, it is possible to eliminate an influence of the dead zone which is shown in FIG. 4 without fail and output an output voltage which corresponds to the quantity of the reflected light.

The signals having the output voltages Vp, Vs are supplied to the control unit 1 which functions as toner quantity deriving means and A/D-converted, after which the control unit 1 calculates the quantity of toner adhering on the intermediate transfer belt 41. According to the present invention, there are different methods of measuring a toner quantity in accordance with the following characteristics in structure of the apparatus:

(a) Whether the length of the circumference of the intermediate transfer belt 41 which corresponds to the "belt-shaped image carrier" is an integer multiple or a non-integer multiple of the length of the circumference of the sensor-facing roller 43;

(b) Whether the thickness of the intermediate transfer belt 41 is even or not; and (c) Whether the condition of a surface of the intermediate transfer belt 41 is uniform or not.

Now, each one of these will be described.

A. First Preferred Embodiment

First, a description will be given on a method of measuring a toner quantity in an image forming apparatus in which the length of the circumference of the intermediate transfer belt 41 is a non-integer multiple of the length of the circumference of the sensor-facing roller 43 and the thickness of the intermediate transfer belt 41 is not even.

Figure 6:
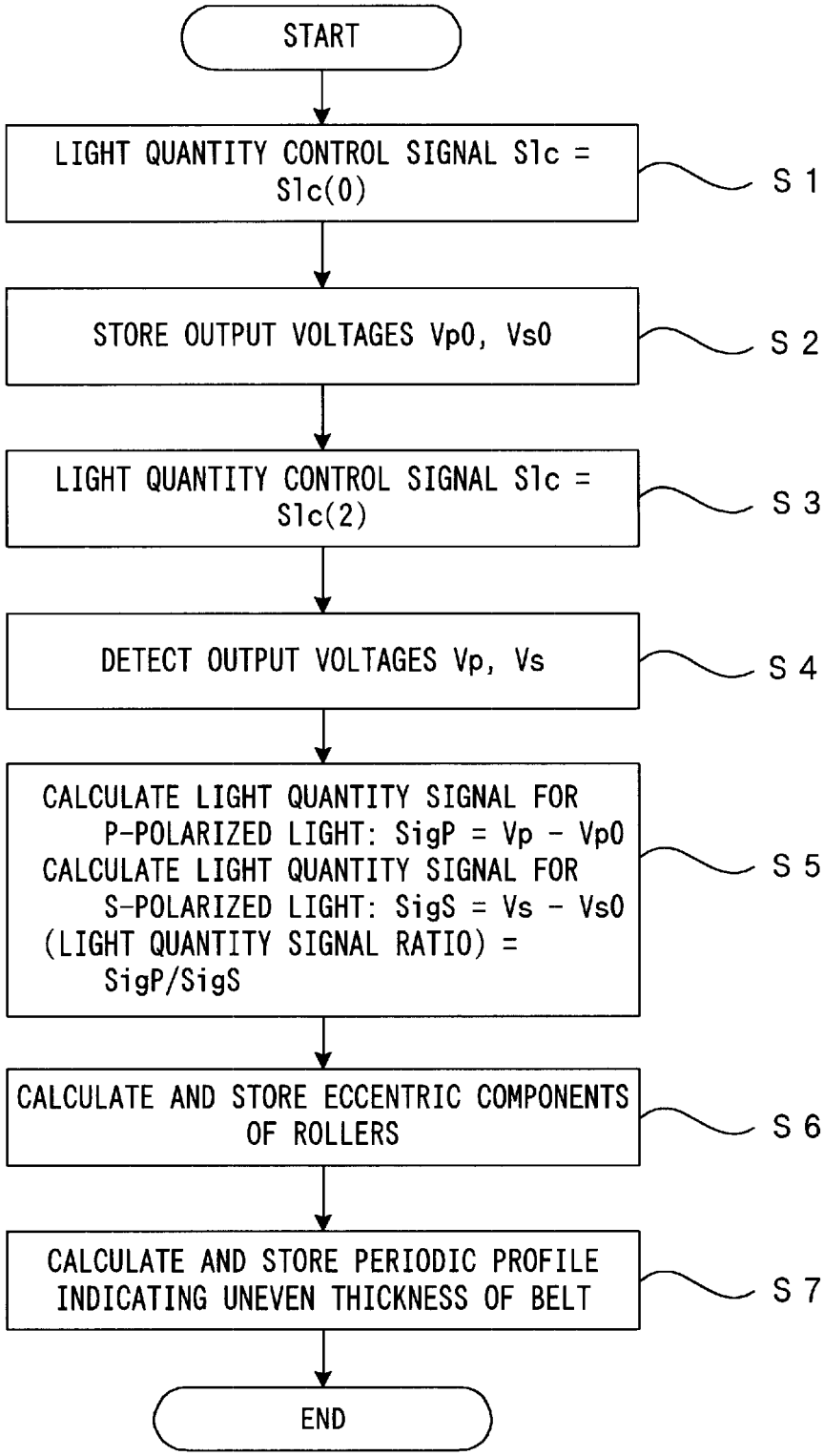
FIG. 6 is a flow chart showing the sequence of deriving eccentric components and a periodic profile prior to measurement of an actual toner quantity.

FIG. 6 is a flow chart showing the sequence of deriving eccentric components and a periodic profile prior to measurement of an actual toner quantity. In this apparatus, the control unit 1 provides the irradiation quantity adjusting unit 605 with the light quantity control signal S1c(0) which corresponds to the turn-off instruction and turns off the light emitting element 601 (Step S1). According to this embodiment in particular, as described above, since the dead zone (signal level S1c(0) to S1c(1) in FIG. 4) is set up by means of application of the input offset voltage 651, and therefore, the light emitting element 601 upon receipt of the light quantity control signal S1c(0) turns off without fail.

An output voltage Vp0 which is indicative of the received quantity of the p-polarized light and an output voltage Vs0 which is indicative of the received quantity of the s-polarized light in this OFF-state are detected and stored in the memory 12 of the control unit 1 (Step S2). In short, a sensor output in the OFF-state, namely, dark output voltages Vpo, Vso are detected and stored.

Next, a signal S1c(2) at a signal level beyond the dead zone is set as the light quantity control signal S1c, and this light quantity control signal S1c(2) is supplied to the irradiation quantity adjusting unit 605 to thereby turn on the light element 601 (Step S3). This causes light from the light emitting element 601 to irradiate upon the intermediate transfer belt 41, the reflection quantity detecting unit 607 to detect the quantities of the p-polarized light and the s-polarized light which are reflected by the intermediate transfer belt 41, and the control unit 1 to receive the output voltages Vp, Vs which correspond to the respective received light quantities (Step S4).

The control unit 1 subtracts the dark output voltage Vp0 from the output voltage Vp with respect to the p-polarized light, thereby calculating a light quantity signal SigP which represents the quantity of the p-polarized light which corresponds to the toner quantity (Step S5). With respect to the s-polarized light as well, similarly to the p-polarized light, the control unit 1 subtracts the dark output voltage Vs0 from the output voltage Vs to yield a light quantity signal SigS which represents the quantity of the s-polarized light which corresponds to the toner quantity (Step S5). A ratio of the light quantity signals SigP and SigS thus corrected is then calculated as sampling data (Step S5). Since the dark output voltages Vp0, Vs0 are removed from the measured output voltages Vp, Vs according to this embodiment, it is possible to accurately calculate the light quantities which correspond to the toner quantity. Therefore, even when there is a change in dark output due to an environmental condition, such as an ambient temperature around the apparatus, or a change with time of the components which form the apparatus, it is possible to obtain an index regarding the toner quantity without affected by these factors.

Figure 7:
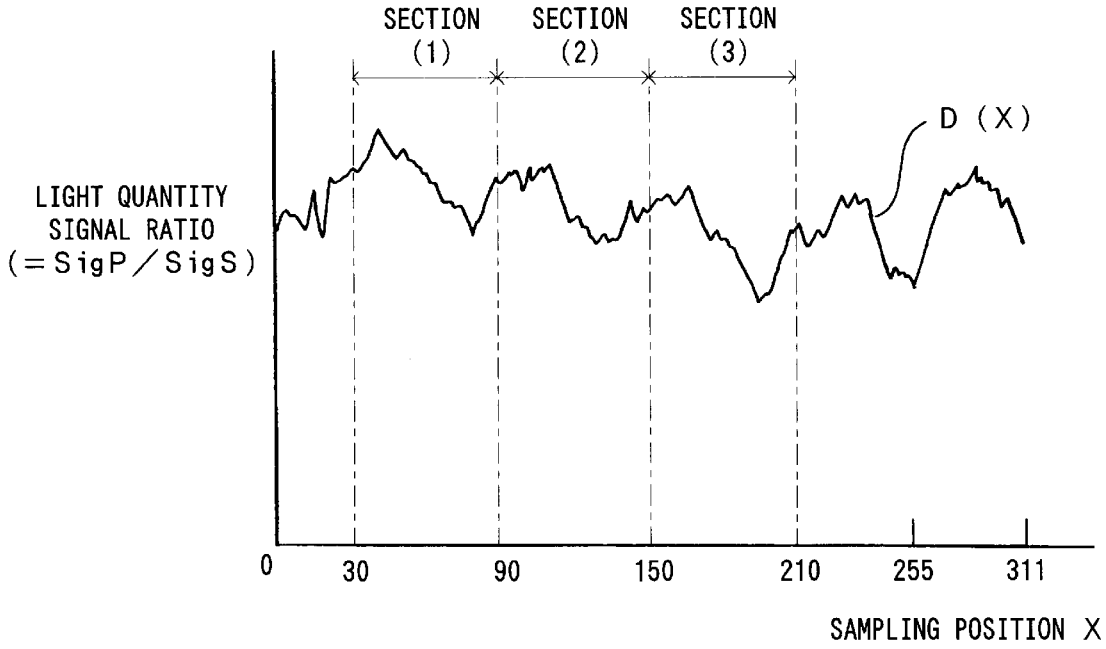
FIG. 7 is a graph showing one example of sampling data outputted from a sensor.

More precisely, the sampling data are obtained in the following manner. In the image forming apparatus according to this embodiment, the length of the circumference of the intermediate transfer belt 41 is a non-integer multiple of the length of the circumference of the sensor-facing roller 43 and the intermediate transfer belt 41 travels one round for approximately every 5.2 rounds of the sensor-facing roller 43. It takes 3120 ms for the intermediate transfer belt 41 to make one round. The quantity of reflected light from the intermediate transfer belt 41 is sampled at intervals of 10 ms, the output voltage Vp0 upon turning off is subtracted from the output voltage Vp as it is at each sampling position x to thereby calculate the light quantity signal SigP (=Vp−Vp0), while the output voltage Vs0 upon turning off is subtracted from the output voltage Vs as it is at each sampling position x to thereby calculate the light quantity signal SigS (=Vs−Vs0). Following this, ratios of these light quantity signals (=SigP/SigS) are stored in the memory 12 as sampling data D(x) at the respective sampling positions x (FIG. 7). In this embodiment, while 312 pieces of sampling data D(x) are obtained while the intermediate transfer belt 41 travels one round, for the purpose of executing efficient calculation using a small memory capacity, the number of samples to take is set to 256. That is, the sampling data D(0), D(1), . . . D(255) are stored in the memory 12.

At the next Step S6, eccentric components of the rollers are calculated on the basis of the sampling data D(0), D(1), D(255) and stored in the memory 12. The details will be now described with reference to FIG. 7. According to this embodiment, since the intermediate transfer belt 41 travels a round every time the roller 43 makes 5.2 rounds, when consecutive 60 (=312/5.2) pieces of sampling data are extracted from the sampling data D(x) above, the 60 sampling data pieces contain components which correspond to one round of the roller 43. Now, noting eccentric components of the roller 43, calculation of an average value representing one round of the sensor-facing roller 43 makes it unnecessary to consider the eccentric components. There is a moment that the sensing distance becomes long and a moment that the sensing distance becomes short while the sensor-facing roller 43 rotates one round, and influences of these are considered to cancel out each other when the average value is calculated. This average value therefore can be viewed approximately equivalent to an average corresponding to a designed sensing distance.

Using the consecutive 60 sampling data pieces as one section, three sections (1) to (3) are defined in the sampling data D(x) as shown in FIG. 7, average values AV(x) representing one round of the roller 43 at the sampling positions x (x=30, 31, . . . , 210) constituting the respective sections are calculated.

$$AV(30)=(D(0)+\ldots+D(30)+\ldots+D(59))/60$$

$$AV(31)=(D(1)+\ldots+D(31)+\ldots+D(60))/60$$

$$AV(32)=(D(2)+\ldots+D(32)+\ldots+D(61))/60$$

. . .

$$AV(210)=(D(180)+\ldots+D(210)+\ldots+D(239))/60$$

While the center of the 60 sampling data pieces at the sampling positions "0" through "59" is 30 in the formulas above, the center is between "29" and "30" in a strict sense. Therefore, the formulas above may be as below:

$$AV(29)=(D(0)+\ldots+D(30)+\ldots+D(59))/60$$

(and so forth)

Thus calculated average values AV(x) are values from which the eccentric components of the roller 43 have been cancelled, and therefore, as the average values AV(x) are subtracted from the sampling data D(x), the eccentric components E(x) of the roller 43 at the respective sampling positions x are calculated. In other words, it is possible to calculate the eccentric components E(x) of the roller 43 by the following:

$$E(x)=D(x)-AV(x)$$

With this formula, however, the calculated eccentric components of the roller 43 are those corresponding to three rounds of the roller 43 for every round of the intermediate transfer belt 41.

Since the sections (1) through (3) each correspond to one round of the roller 43, if the phase remains the same, the eccentric components E(x) must have the same value. Noting this, average values Eav(a) of the eccentric components where the sections (1) through (3) are in the same phase are calculated as follows:

$$Eav(a)=\{D(30+a)-AV(30+a)\}+\{D(90+a)-AV(90+a)\}+\{D(120+a)-D(120+a)\}/3 \quad (1)$$

(where a=0, 1, . . . 59)

In this manner, according to this embodiment, since three eccentric components are calculated while the intermediate transfer belt 41 travels one round and an average values of these three is then calculated, the eccentric components of the roller 43 are calculated at a high accuracy. Of course, the number of revolutions of the roller 43 per one round of the intermediate transfer belt 41 is not limited to "5.2" but may only be two or more, in which case it is possible to calculate the eccentric components of the roller 43 in the manner similar to the above.

Figure 8:
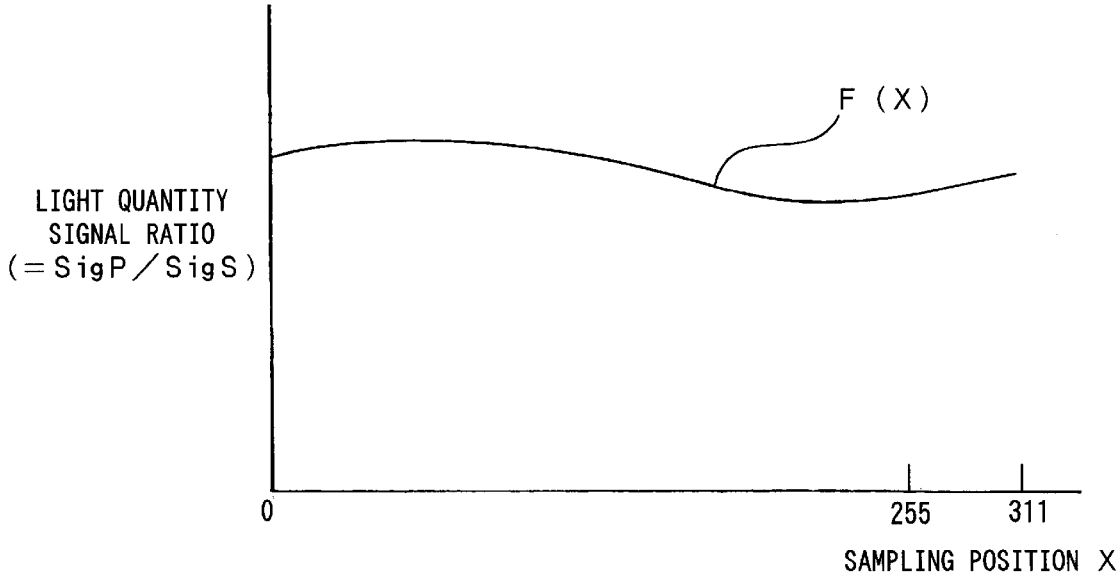
FIG. 8 is a graph showing a periodic profile of an intermediate transfer belt which is obtained by removing eccentric components of a driving roller from the sampling data shown in FIG. 7.

As the eccentric components Eav(a) of the roller 43 in the respective phases are calculated by the formula (1) (Step S6), the eccentric components are subtracted from the sampling data D(x), to thereby detect a periodic profile F(x) which reflects evenness in thickness of the intermediate transfer belt 41 (FIG. 8). In short, the periodic profile F(x) is as follows:

$$F(0)=D(0)-Eav(30)$$

$$F(1)=D(1)-Eav(31)$$

. . .

$$F(29)=D(29)-Eav(59)$$

$$F(30)=D(30)-Eav(0)$$

$$F(31)=D(31)-Eav(1)$$

. . .

The periodic profile F(x) is then stored in the memory 12 in preparation for measurement of an actual quantity of toner (Step S7).

Figure 9:
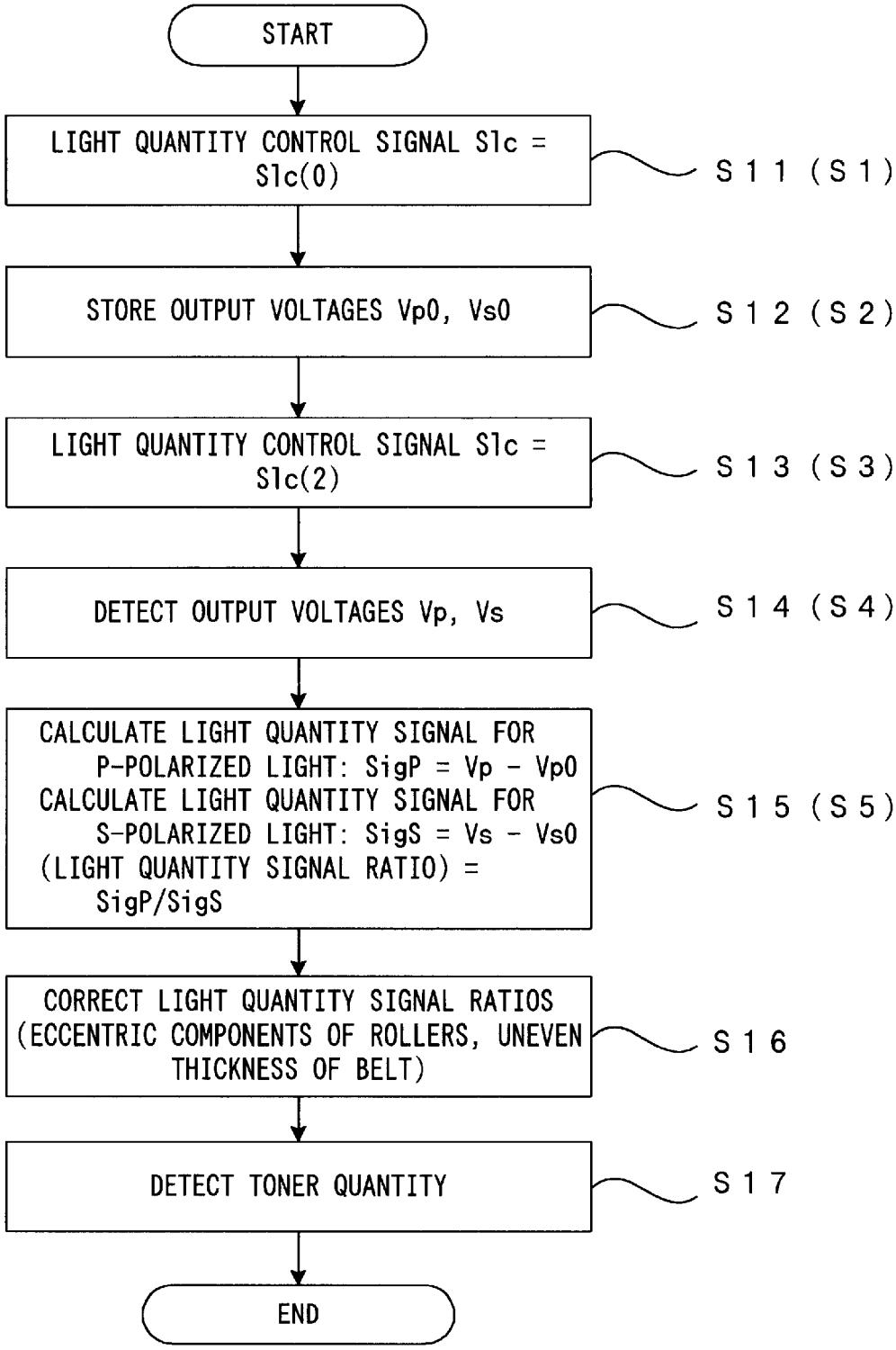
FIG. 9 is a flow chart of a toner quantity measuring operation (first preferred embodiment) in the image forming apparatus shown in FIG. 1.

Next, the sequence of measurement of an actual quantity of toner will be described with reference to FIG. 9. FIG. 9 is a flow chart showing a toner quantity measuring operation in the image forming apparatus shown in FIG. 1. In this apparatus, the control unit 1 executes steps (Step S11 to Step S15) similar to Step S11 to Step S5 which are used in the sequence of deriving the eccentric components and the periodic profile, a light quantity signal ratio (=SigP/SigS) which serves as an index regarding a toner quantity is calculated as the sampling data D(x) and stored in the memory 12.

Next, at Step S16, the light quantity signal ratio obtained as described above is corrected using the eccentric components Eav(a) and the periodic profile F(x). The sequence of this correction is as described below.

First, in this embodiment, every time the sensor-facing roller 43 makes approximately 5.2 rounds, the intermediate transfer belt 41 travels one round. Hence, the sensor-facing roller 43 is in different phases between upon calculation of the eccentric components and the periodic profile above and upon later detection for the purpose of calculation of a toner quantity. However, a ratio between the length of the circumference of the sensor-facing roller 43 and the length of the intermediate transfer belt 41 is known for a design purpose. Noting this, based on how many rounds the intermediate transfer belt 41 has traveled since calculation of the eccentric components and the periodic profile until detection of a toner quantity, the phases of the eccentric components are shifted and matched with the phase of the sensor-facing roller 43 at it is upon toner quantity detection. The periodic profile and the eccentric components are thereafter synthesized, and the light quantity signal ratio is corrected.

Through the processing described above, it is possible to correct an influence of the eccentric components of the roller and the uneven thickness of the intermediate transfer belt 41. The toner quantity is then measured in accordance with the result of the correction (Step S17).

As described above, according to this embodiment, after the eccentric components Eav(a) of the roller are calculated from the sampling data D(x), the eccentric components Eav(a) are subtracted from the sampling data D(x) to calculate the periodic profile F(x) (Step S7), and therefore, the periodic profile F(x) which are indicative of the uneven thickness of the intermediate transfer belt 41 do not contain the eccentric components of the roller but accurately represent the uneven thickness of the intermediate transfer belt 41.

Further, the sampling data D(x) obtained for measurement of an actual toner quantity are corrected (Step S16) using thus accurately obtained periodic profile F(x), and the toner quantity is measured in accordance with the correction value (Step S17), and hence, it is possible to improve the accuracy of measuring the toner quantity.

In addition, since this embodiment suppresses not only unevenness in thickness of the intermediate transfer belt 41 but also a change in distance (sensing distance) between the sensor 6 and the intermediate transfer belt 41 and corrects a change in distance due to eccentric components of the roller, it is possible to further improve the measuring accuracy. More specifically, this embodiment realizes the following two effects.

In the conventional apparatus described above, namely, the apparatus which is described in Japanese Patent Application Unexamined Gazette No. H11-258872, the sensor is located at a position far away from the roller and the intermediate transfer belt 41 dances in a direction which is approximately perpendicular to the direction in which the belt travels. Therefore, the sensing distance between the sensor 6 and the intermediate transfer belt 41 changes at random or in an instable manner, and an output from the sensor becomes instable because of the varying distance. In contrast, according to this embodiment, light irradiates upon the surface area of the intermediate transfer belt where the belt is wound around the roller 43, i.e., the wind area 41*a*, light reflected in the wind area 41*a* is received by the light receiving elements 672*p* and 672*s*, and a toner quantity is measured in accordance with the signal which is outputted from the sensor 6. In the wind area 41*a*, it is possible to prevent instable flaps of the intermediate transfer belt 41 in the direction which is approximately perpendicular to the direction in which the belt travels.

Further, according to this embodiment, since the eccentric components Eav(a) of the roller are calculated (Step S6) to thereby correct a change in sensing distance between the sensor 6 and the intermediate transfer belt 41 which is attributed to the eccentricity of the roller (Step S16), it is possible to suppress an influence of the eccentricity of the roller and further improve the measuring accuracy.

Further, while there is a danger that toner may fall off floating from the intermediate transfer belt 41 and adhere to the sensor 6 during measurement of the quantity of the toner on the intermediate transfer belt 41. Since the sensor 6 is arranged at a horizontal opposing position with respect to the roller 43 which is the sensor-facing roller, a sensing surface stands vertically, which in turn makes it possible to effectively prevent the floating toner from adhering to the sensing surface and improve the measuring accuracy. This effect remains similar or even improves, even when the sensor 6 is disposed above the horizontal opposing position to the roller 43 (FIG. 2) and at a position opposed to the roller 43.

Further, according to this embodiment, the light quantity signal SigP representing the quantity of the p-polarized light and the light quantity signal SigS representing the quantity of the s-polarized light among the light components of the reflected light from the intermediate transfer belt 41, are calculated independently of each other, and the quantity of the toner adhering on the intermediate transfer belt 41 is measured based on the light quantity signal ratio (=SigP/SigS). Therefore, a noise, the changing quantity of the irradiated light upon the intermediate transfer belt 41 and the like are not easily influential, and it is possible to measure the toner quantity at a high accuracy.

Further, while it is necessary to turn off the light emitting element 601 without fail for calculation of dark outputs, according to this embodiment, as the input offset voltage 651 is applied as described above, the light emitting element 601 turns off without fail.

B. Second Preferred Embodiment

Next, a description will be given on a method of measuring a toner quantity in an image forming apparatus in which the length of the circumference of the intermediate transfer belt 41 is an integer multiple of the length of the circumference of the sensor-facing roller 43 and the thickness of the intermediate transfer belt 41 is uneven.

Figure 10:
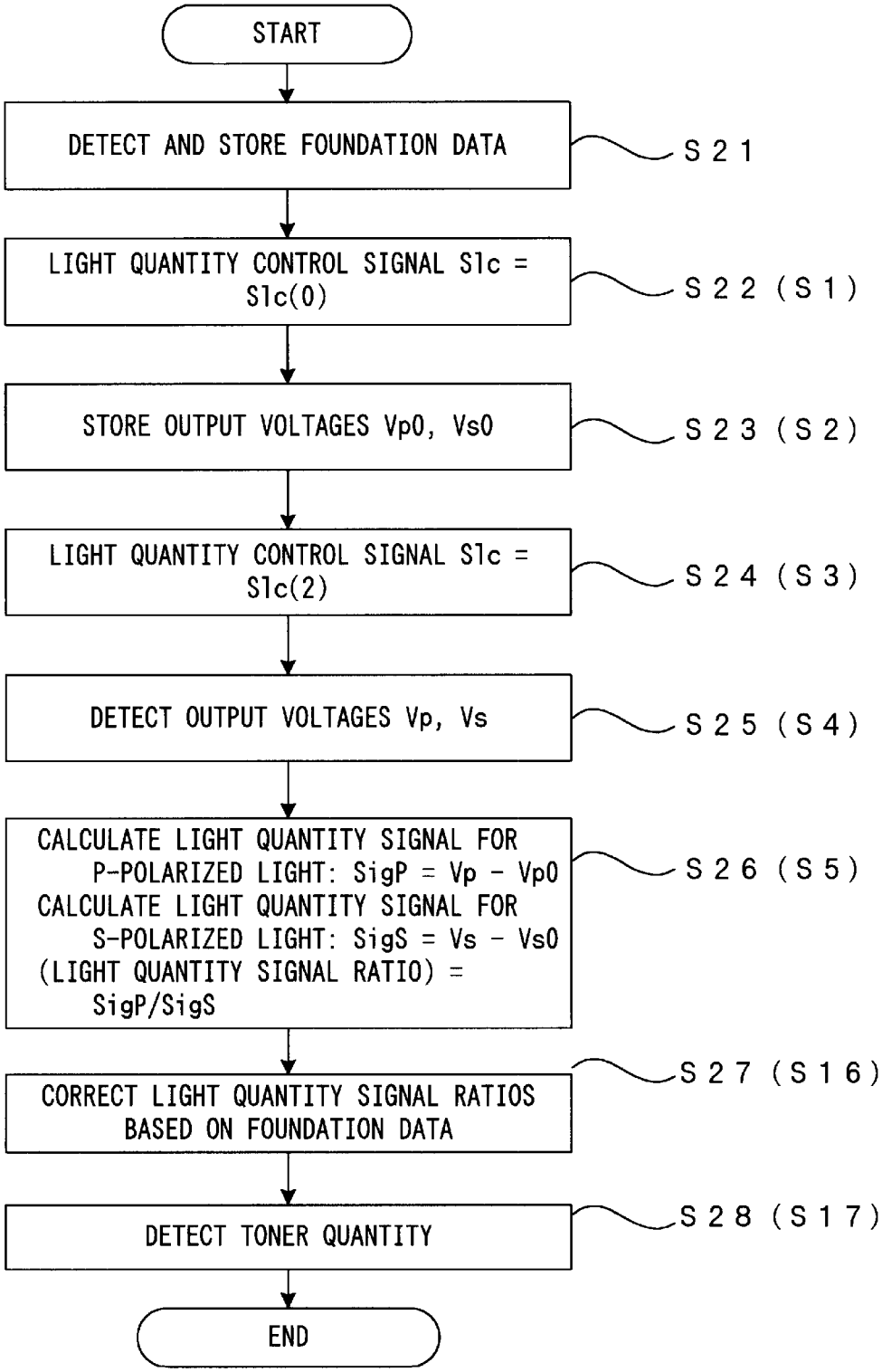
FIG. 10 is a flow chart of a toner quantity measuring operation (second preferred embodiment) in the image forming apparatus shown in FIG. 1.

In an image forming apparatus in which the length of the circumference of the intermediate transfer belt 41 is an integer multiple of the length of the circumference of the sensor-facing roller 43, as the quantity of toner is measured in the sequence which is shown in FIG. 10, a change in distance (sensing distance) between the sensor 6 and the intermediate transfer belt 41 is suppressed, an influence of eccentric components of the roller and the uneven thickness of the intermediate transfer belt 41 is corrected, and the quantity of toner adhering to the intermediate transfer belt 41 is measured at a high accuracy in a manner similar to that in the first preferred embodiment.

FIG. 10 is a flow chart showing a toner quantity measuring operation in an image forming apparatus according to the present invention (second preferred embodiment). The output voltages Vp and Vs which correspond to the quantity of reflected light from the intermediate transfer belt 41 are sampled at predetermined sampling intervals (e.g., 10 ms) while the intermediate transfer belt 41, which does not bear a toner image, makes one round. After the dark output voltage Vp0 is subtracted from the output voltage Vp to thereby calculate the light quantity signal SigP representing the quantity of the p-polarized light which corresponds to the quantity of toner while the dark output voltage Vs0 is subtracted from the output voltage Vs to thereby calculate the light quantity signal SigS representing the quantity of the s-polarized light which corresponds to the quantity of toner as described above. Thereafter, a ratio between thus corrected light quantity signals SigP and SigS is calculated and light quantity signal ratios R(x) at the respective sampling positions x are stored in the memory 12 as foundation data (Step S21). The foundation data R(x) calculated in this manner contain the eccentric components of the roller and the uneven thickness of the belt described in detail above. In addition, since the length of the circumference of the intermediate transfer belt 41 is an integer multiple of the length of the circumference of the sensor-facing roller 43, there is not a phase difference between the two regardless of the number of rotations.

Steps (Step S22 to Step S26) similar to Step S1 to Step S5 according to the first preferred embodiment are executed for measurement of an actual toner quantity, whereby the light quantity signal ratios (=SigP/SigS) which serve as an index regarding a toner quantity are calculated as the sampling data D(x) and stored in the memory 12.

Following this, after the sampling data D(x) are corrected based on the foundation data R(x) (Step S27), the quantity of the toner is detected based on the corrected light quantity signal ratios (Step S28).

As described above, according to the second preferred embodiment, the foundation data R(x) are subtracted from the sampling data D(x) and an influence of the eccentric components of the roller and the uneven thickness of the belt is corrected, so that the quantity of the toner adhering to the intermediate transfer belt 41 is measured at a high accuracy. Hence, as compared with the first preferred embodiment, the second preferred embodiment realizes a new effect that highly accurate toner measurement is possible through a fewer processing steps, in addition to the effect obtainable according to the first preferred embodiment.

C. Third Preferred Embodiment

Next, a description will be given on a method of measuring a toner quantity in an image forming apparatus in which the length of the circumference of the intermediate transfer belt 41 is a non-integer multiple of the length of the circumference of the sensor-facing roller 43 and the condition of a surface of the intermediate transfer belt 41 is not uniform.

Figure 11:
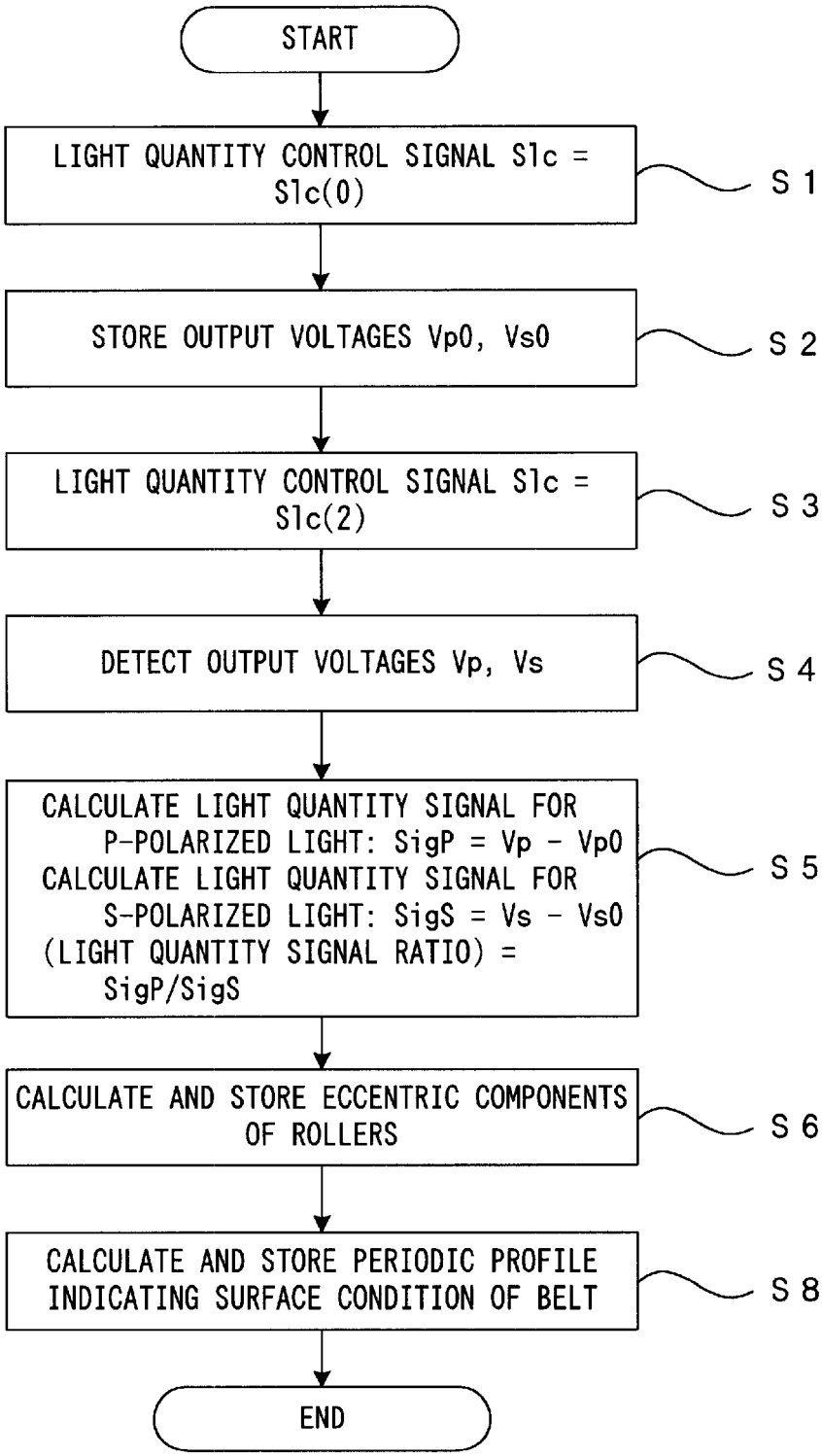
FIG. 11 is a flow chart showing the sequence of deriving eccentric components and a periodic profile prior to measurement of an actual toner quantity in a third preferred embodiment.

FIG. 11 is a flow chart showing the sequence of deriving eccentric components and a periodic profile prior to measurement of an actual toner quantity. According to the third preferred embodiment as well, the same processing as that through Step S1 to Step S6 according to the first preferred embodiment is executed, and the eccentric components Eav(a) of the roller 43 are calculated and stored in the memory 12. In the third preferred embodiment, however, since the condition of a surface of the intermediate transfer belt 41 is not uniform while the thickness of the intermediate transfer belt 41 is constant, Step S8 is executed to thereby yield a periodic profile F'(x) which is indicative of the condition of the surface of the intermediate transfer belt 41.

Figure 12:
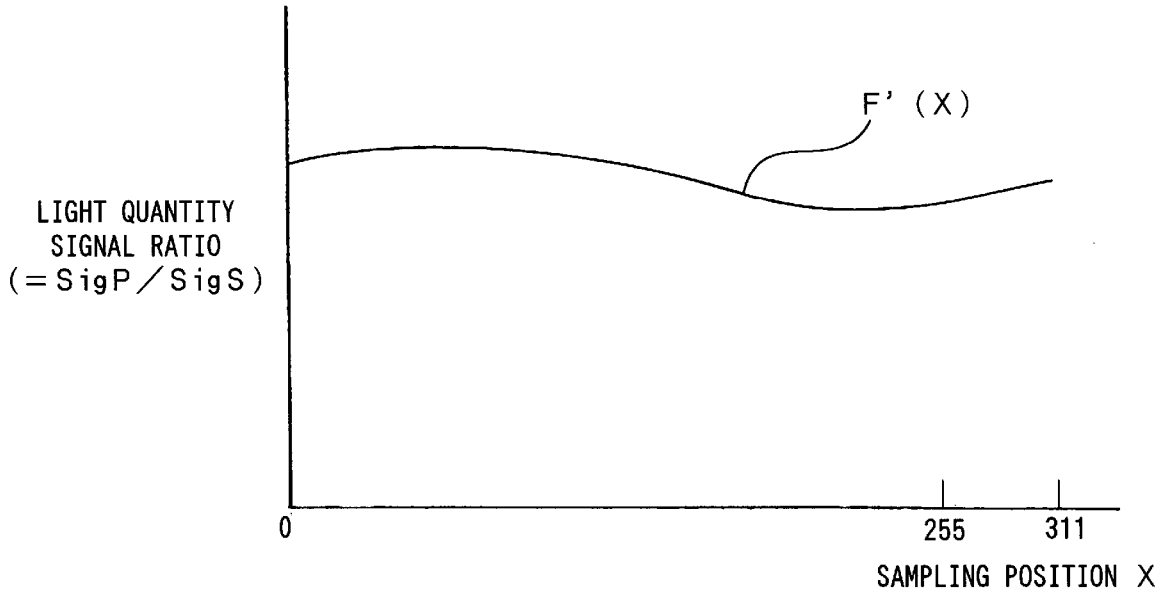
FIG. 12 is a graph showing a periodic profile of an intermediate transfer belt which is obtained in accordance with the derivation sequence shown in FIG. 11.

At Step S8, the eccentric components are subtracted from the sampling data D(x) and the periodic profile F'(x) which reflects the condition of the surface of the intermediate transfer belt 41 is detected (See FIG. 12). In other words, the periodic profile F'(x) as follow are obtained:

$$F'(0)=D(0)-Eav(30)$$

$$F'(1)=D(1)-Eav(31)$$

$$\ldots$$

$$F'(29)=D(29)-Eav(59)$$

$$F'(30)=D(30)-Eav(0)$$

$$F'(31)=D(31)-Eav(1)$$

$$\ldots$$

The periodic profile F'(x) is then stored in the memory 12, in preparation for measurement of an actual quantity of toner (Step S8).

Figure 13:
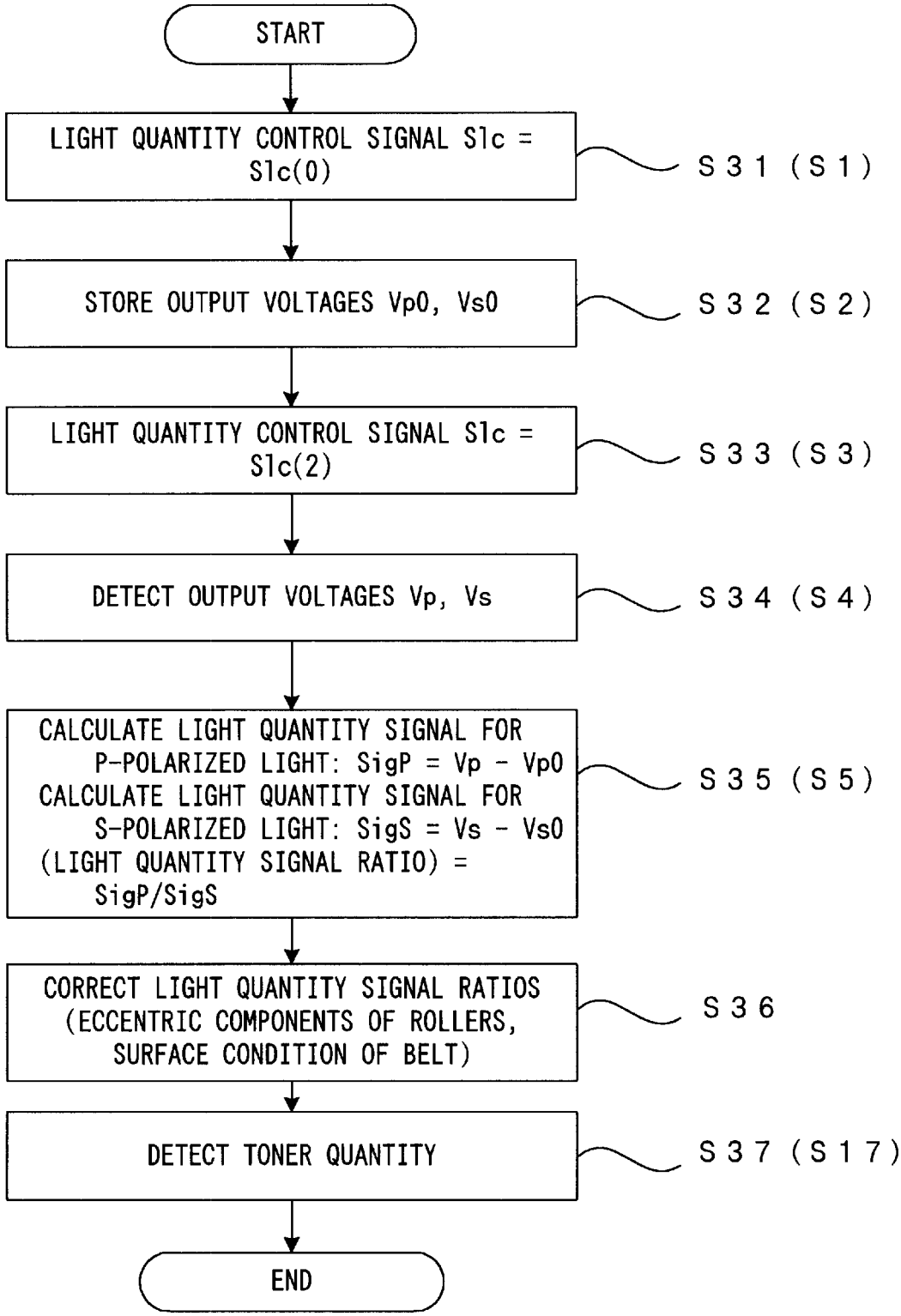
FIG. 13 is a flow chart of a toner quantity measuring operation (third preferred embodiment) in the image forming apparatus shown in FIG.

Next, the sequence of measuring an actual quantity of toner will be described with reference to FIG. 13. FIG. 13 is a flow chart showing a toner quantity measuring operation in the image forming apparatus shown in FIG. 1 (third preferred embodiment). In this apparatus, the control unit 1 executes steps (Step S31 to Step S35) similar to Step S1 to Step S5 which are used in the sequence of deriving the eccentric components and the periodic profile, light quantity signal ratios (=SigP/SigS) which serve as an index regarding a toner quantity are calculated as the sampling data D(x) and stored in the memory 12.

Next, at Step S36, the light quantity signal ratios obtained as described above are corrected using the eccentric components Eav(a) and the periodic profile F'(x). The sequence of this correction is as described below.

First, in this embodiment, every time the sensor-facing roller 43 makes approximately 5.2 rounds, the intermediate transfer belt 41 travels one round. Hence, the sensor-facing roller 43 is in different phases between upon calculation of the eccentric components and the periodic profile above and upon later detection for the purpose of calculation of a toner quantity. However, a ratio between the length of the circumference of the sensor-facing roller 43 and the length of the intermediate transfer belt 41 is known for a design purpose. Noting this, based on how many rounds the intermediate transfer belt 41 has traveled since calculation of the eccentric components and the periodic profile until detection of a toner quantity, the phases of the eccentric components are shifted and matched with the phase of the sensor-facing roller 43 at it is upon toner quantity detection. The periodic profile and the eccentric components are thereafter synthesized, and the light quantity signal ratios are corrected (Step S36).

Through the processing described above, it is possible to correct an influence of the eccentric components of the roller and the condition of the surface of the intermediate transfer belt 41. The toner quantity is then measured in accordance with the result of the correction (Step S37).

As described above, according to this embodiment, after the eccentric components Eav(a) of the roller 43 are calculated from the sampling data D(x), the eccentric components Eav(a) are subtracted from the sampling data D(x) to calculate the periodic profile F'(x) (Step S36), and therefore, the periodic profile F'(x) which is indicative of the condition of the surface of the intermediate transfer belt 41 do not contain the eccentric components of the roller but accurately represent the condition of the surface of the intermediate transfer belt 41.

Further, the sampling data D(x) obtained for measurement of an actual toner quantity are corrected (Step S36) using thus accurately obtained periodic profile F'(x), and the toner quantity is measured in accordance with the correction value (Step S37), and hence, it is possible to improve the accuracy of measuring the toner quantity.

In addition, since this embodiment suppresses not only a change in surface condition of the intermediate transfer belt 41 but also a change in distance (sensing distance) between the sensor 6 and the intermediate transfer belt 41 and corrects a distance change due to eccentric components of the roller, it is possible to further improve the measuring accuracy as in the first preferred embodiment.

D. Fourth Preferred Embodiment

Next, a description will be given on a method of measuring a toner quantity in an image forming apparatus in which the length of the circumference of the intermediate transfer belt 41 is an integer multiple of the length of the circumference of the sensor-facing roller 43.

Figure 14:
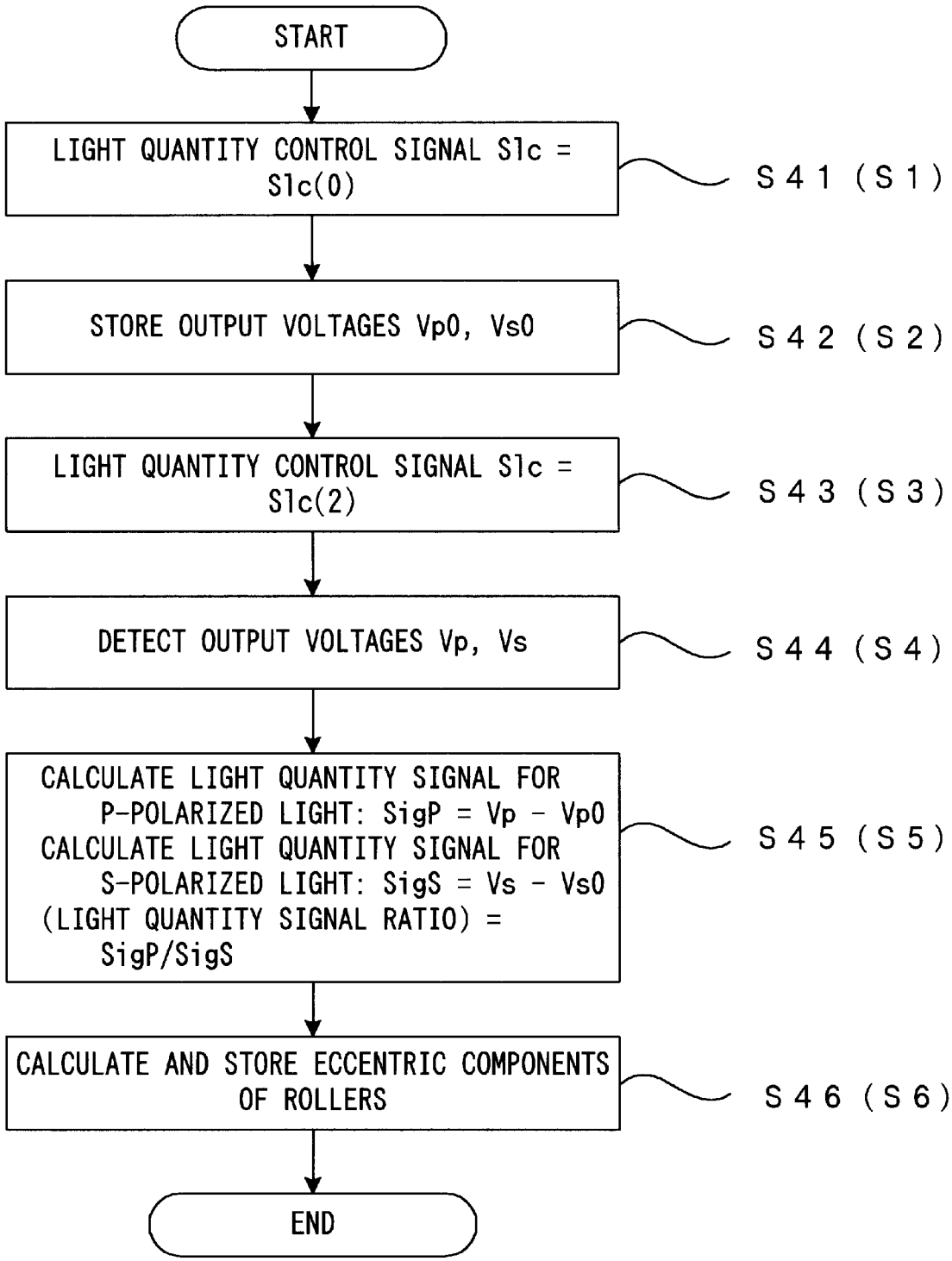
FIG. 14 is a flow chart showing the sequence of deriving eccentric components prior to measurement of an actual toner quantity in a fourth preferred embodiment.

FIG. 14 is a flow chart showing the sequence of deriving eccentric components prior to measurement of an actual toner quantity in the fourth preferred embodiment. According to the fourth preferred embodiment as well, the same processing as that through Step S1 to Step S6 according to the first preferred embodiment is executed, and eccentric components of the roller 43 are calculated and stored in the memory 12. The fourth preferred embodiment, however, is largely different from the first preferred embodiment with respect to a method of acquiring sampling data.

Figure 15:
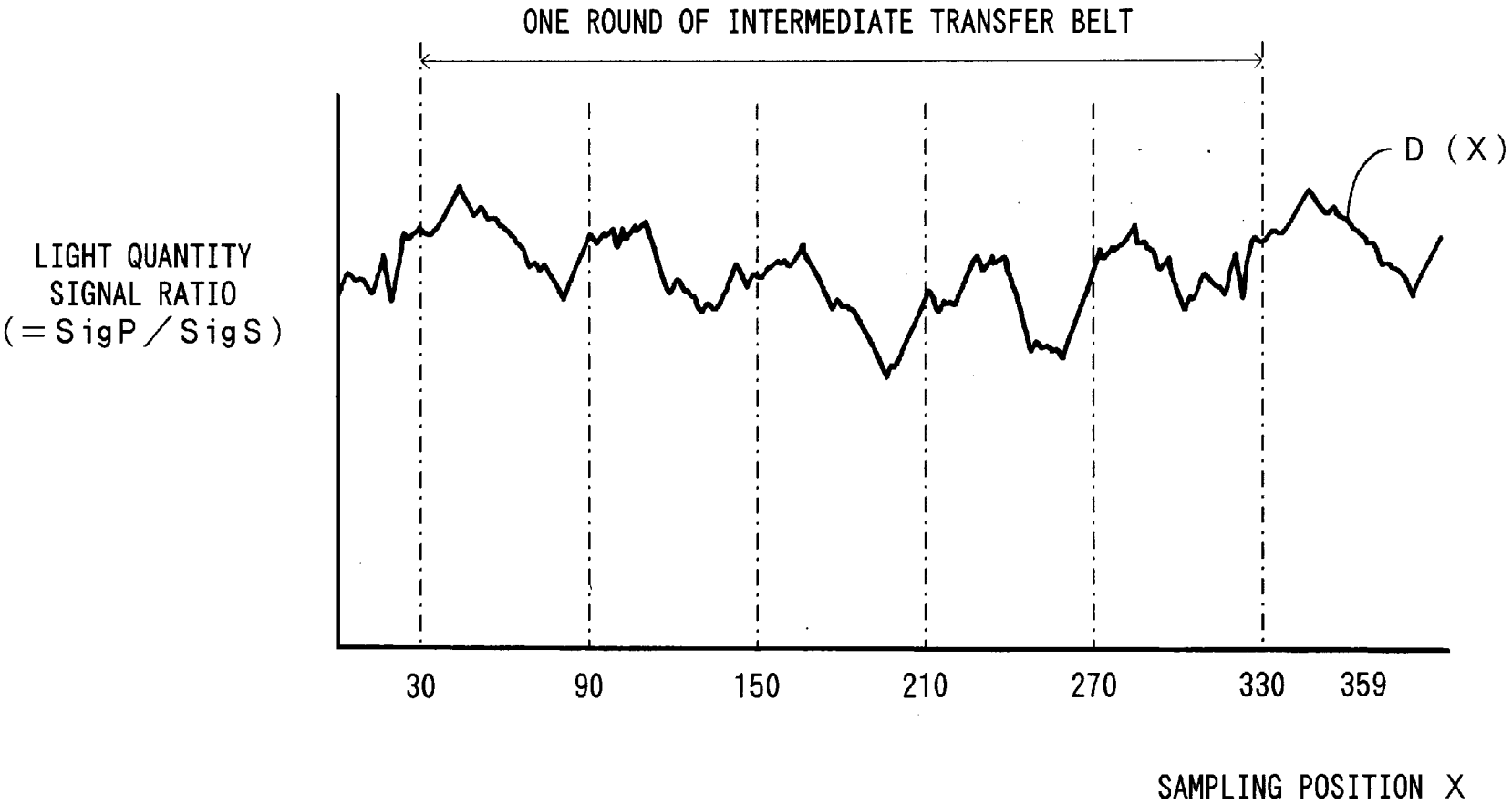
FIG. 15 is a graph showing one example of sampling data outputted from a sensor in the fourth preferred embodiment.
Figure 16:
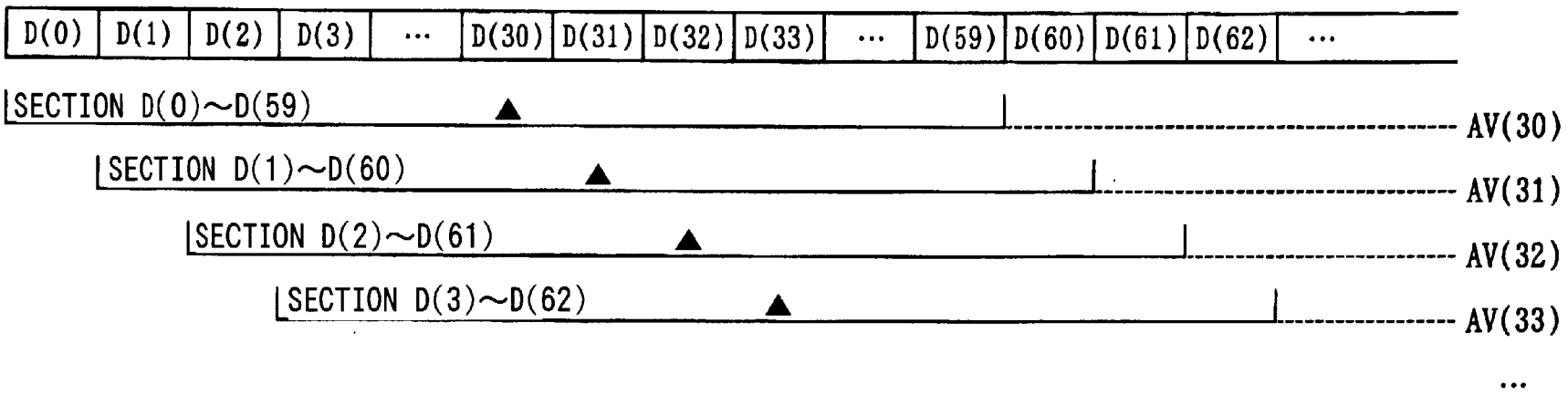
FIG. 16 is a schematic diagram for describing the sequence of deriving eccentric components in the fourth preferred embodiment.

In an image forming apparatus according to the fourth preferred embodiment, the length of the circumference of the intermediate transfer belt 41 which corresponds to the "belt-shaped image carrier" is an integer multiple of the length of the circumference of the sensor-facing roller 43, and every time the sensor-facing roller 43 makes five rounds, the intermediate transfer belt 41 travels one round. It takes 3000 ms for the intermediate transfer belt 41 to make one round. The quantity of reflected light from the intermediate transfer belt 41 is sampled at intervals of 10 ms, at Step S45 the output voltage Vp0 upon turning off is subtracted from the output voltage Vp as it is at each sampling position X to thereby calculate the light quantity signal SigP (=Vp−Vp0), while the output voltage Vs0 upon turning off is subtracted from the output voltage Vs as it is at each sampling position X to thereby calculate the light quantity signal SigS (=Vs−Vs0). Following this, a ratio between these light quantity signals (=SigP/SigS) is stored in the memory 12 as sampling data D(x) at each sampling position X (FIGS. 15 and 16). In this embodiment, the intermediate transfer belt 41 travels one round every time the sensor-facing roller 43 makes five rounds and 300 pieces of sampling data D(x) are obtained during this, for the purpose of calculating eccentric components of the roller 43 using a small memory capacity in a short period of time as described later, 360 pieces of sampling data D(0) to D(359) which are obtained while the roller 43 rotates six rounds are sampled and stored in the memory 12.

Next, at Step S46, eccentric components of the roller are calculated from the sampling data D(0), D(1), . . . D(359) and stored in the memory 12. The details will be now described with reference to FIGS. 15 and 16. According to this embodiment, since the intermediate transfer belt 41 travels one round while the roller 43 rotates five rounds, while consecutive 60 (=300/5) pieces of sampling data are yielded from the sampling data D(x) described above, the 60 sampling data pieces contain components which correspond to one round of the roller 43. Now, noting eccentric components of the roller 43, calculation of an average value representing one round of the sensor-facing roller 43 makes it unnecessary to consider the eccentric components. There is a moment that the sensing distance becomes long and a moment that the sensing distance becomes short while the sensor-facing roller 43 rotates one round, and influences of these are considered to cancel out each other when the average value is used. This average value therefore can be viewed approximately equivalent to an average corresponding to a designed sensing distance.

Using the consecutive 60 sampling data pieces as one section, 301 sections, i.e., a section D(0) to D(59), a section D(1) to D(60), . . . , a section D(300) to D(359) are defined, and average values AV(x) corresponding to one round of the roller 43 at the center positions X (X=30, 31, . . . , 330) in the respective sections are calculated.

$$AV(30)=(D(0)+\ldots+D(30)+\ldots+D(59))/60$$

$$AV(31)=(D(1)+\ldots+D(31)+\ldots+D(60))/60$$

$$AV(32)=(D(2)+\ldots+D(32)+\ldots+D(61))/60$$

$$\ldots$$

$$AV(330)=(D(300)+\ldots+D(330)+\ldots+D(359))/60$$

While the center of the 60 sampling data pieces at the sampling positions "0" through "59" is 30 in the formulas above, the center is between "29" and "30" in a strict sense. Therefore, the formulas above may be as below:

$$AV(29)=(D(0)+\ldots+D(30)+\ldots+D(59))/60$$

(and so forth)

Thus calculated average values AV(X) are values from which the eccentric components of the roller 43 have been cancelled, and therefore, as the average values AV(X) are subtracted from the sampling data D(X), the eccentric components E(X) of the roller 43 at the respective sampling positions X are calculated. In other words, it is possible to calculate the eccentric components E(X) of the roller 43 by the following:

$$E(X)=D(X)-AV(X)$$

(where X=30, 31, . . . 329)

Figure 17:
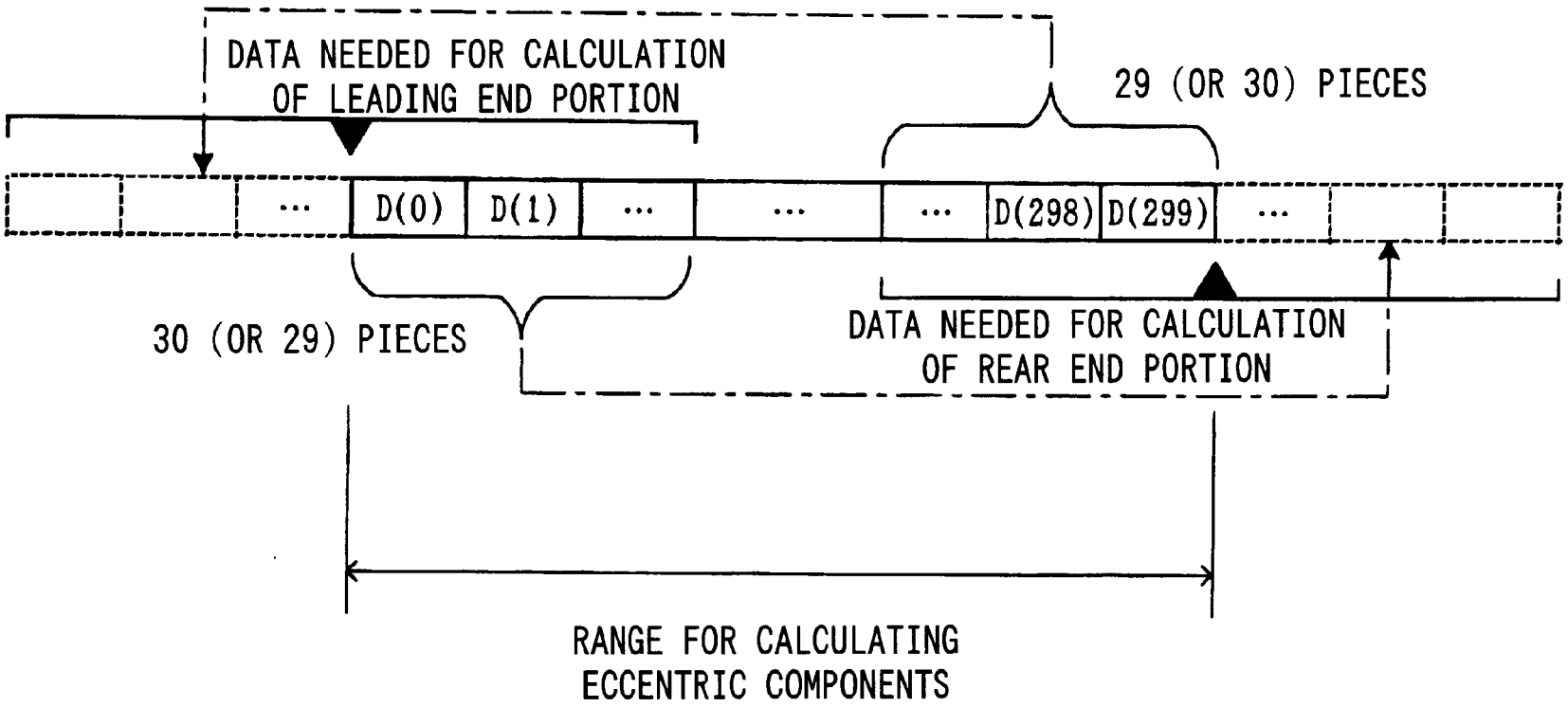
FIG. 17 is a schematic diagram for describing the sequence of deriving eccentric components in a modification.

Although this embodiment requires to obtain 360 pieces of the sampling data while rotating the roller 43 one more extra round than the number of rotation n (n=5) of the roller 43 which is needed for the intermediate transfer belt 41 to travel one round, and to thereafter calculate the eccentric components E(X) of the roller 43 based on these data pieces as described above, this may be modified to acquire 300 pieces of data while the roller 43 rotates n rounds (n=5) and to calculate the eccentric components E(X) of the roller 43 based on the 300 pieces of data. The fourth preferred embodiment, however, realizes a better effect as compared to the modification. Now, this will be described below.

Where data corresponding to only one round of the intermediate transfer belt 41 are sampled as in the modification, for calculation of eccentric components contained in one round of the belt, as shown in FIG. 17, it is necessary to supplement sampling data close to a rear end portion of the belt to calculation in the vicinity of a leading end portion of the belt and to supplement sampling data close to the leading end portion of the belt to calculation in the vicinity of the rear end portion of the belt. For this reason, the average values AV(X) and the eccentric components E(X) can be calculated only after the 300 pieces of data are stored in the memory 12. Hence, the memory 12 needs be prepared to have a memory space to store the 300 pieces of sampling data.

In contrast, according to the fourth preferred embodiment, since the roller 43 rotates one more extra round, it is possible to calculate the first average value AV(X), and hence, the eccentric components E(X), immediately after acquiring 60 pieces of data since the start of data sampling. Further, the earliest data become unnecessary upon derivation of the eccentric components. This equally applies to the eccentric components at the subsequent sampling positions X, and therefore, a memory space which must be ensured in the memory 12 for the purpose of calculation only needs be large enough to hold 60 pieces of sampling data, which allows to reduce the memory size. In addition, this allows to execute the sampling operation and the calculation of eccentric components partially in parallel, and hence, to increase the overall processing speed.

Figure 18:
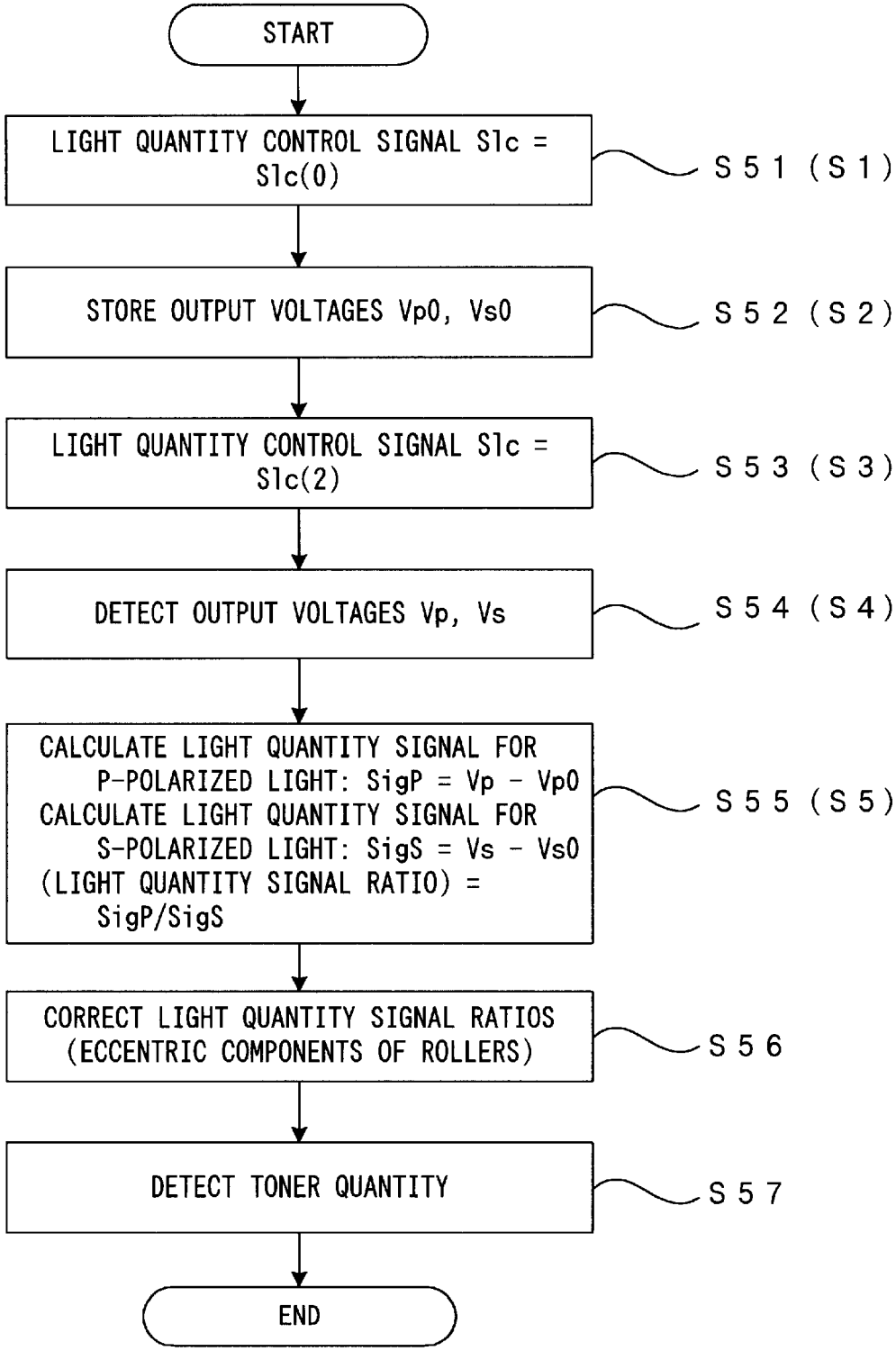
FIG. 18 is a flow chart of a toner quantity measuring operation (fourth preferred embodiment) in the image forming apparatus shown in FIG. 1.

Now, the sequence of measuring an actual quantity of toner will be described with reference to FIG. 18. FIG. 18 is a flow chart showing a toner quantity measuring operation in the image forming apparatus shown in FIG. 1 (fourth preferred embodiment). In this apparatus, the control unit 1 executes steps (Step S51 to Step S55) similar to Step S1 to Step S5 which are used in the sequence of deriving the eccentric components, light quantity signal ratios (=SigP/SigS) which serve as an index regarding a toner quantity are calculated as the sampling data D(X) and stored in the memory 12.

Figure 19:
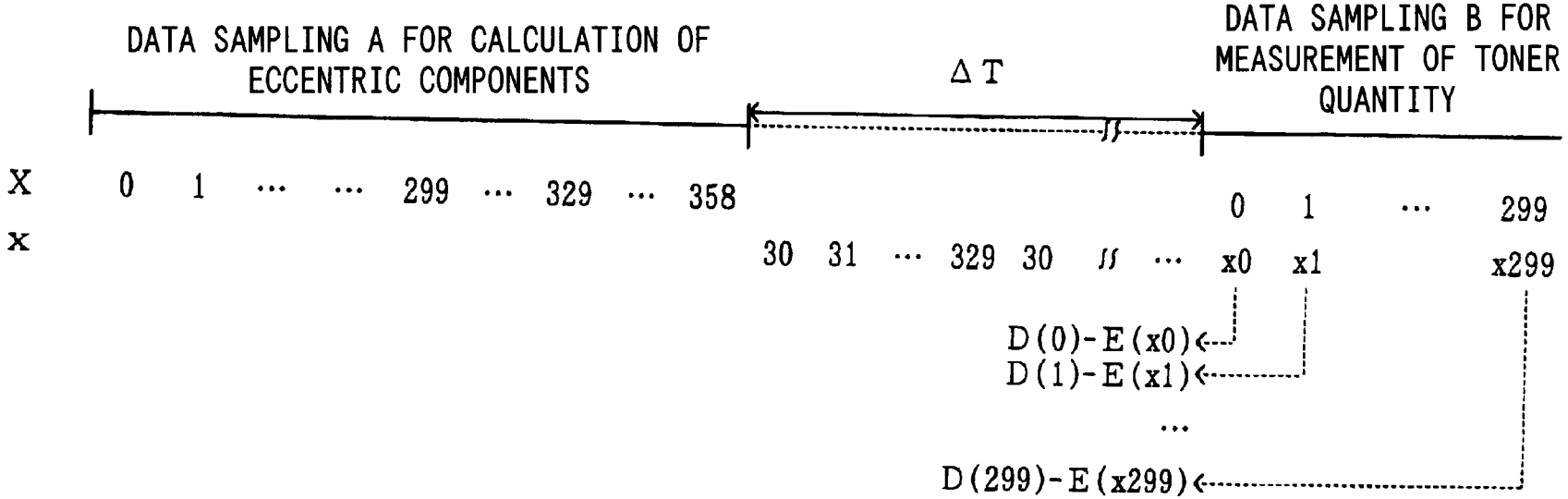
FIG. 19 is a schematic diagram for describing the sequence of correcting sampling data in the fourth preferred embodiment.

Next, at Step S56, the light quantity signal ratios obtained as described above are corrected using eccentric components E(x). The challenge at this stage is how to match the eccentric components E(30), E(31), . . . E(329) obtained as described above with the data pieces D(0), D(1), . . . D(299) sampled for toner quantity measurement, since after the data sampling for calculation of the eccentric components E(X) of the roller 43 (sampling A), the timing for starting data sampling for toner quantity measurement (sampling B) is not always constant, as shown in FIG. 19. Noting this, the fourth preferred embodiment uses a different count value x to solve this problem, as shown in FIG. 19. In short, after completing the data sampling A for calculation of eccentric components, cyclic counting processing is executed in which the count value x is incremented one at a time at intervals of 10 ms but returns to 30 once again upon reaching 329 while the roller 43 rotates. Hence, the count value x0 upon sampling of the first piece of data D(0) during the sampling B is a value between 30 and 329 which corresponds to a time interval AT until the start of the sampling B since the end of the sampling A. Therefore, regardless of the time interval ΔT, the eccentric components E(x) and the sampling data D(X) are appropriately associated with each other, which solves the problem above.

Every time the sampling data piece D(X) is obtained, the corresponding eccentric component E(x) is subtracted from the sampling data piece D(X). Hence, it is possible to correct the eccentric components of the roller by the formulas below:

$$D(0)-E(x0)$$

$$D(1)-E(x1)$$

$$\ldots$$

$$D(299)-E(x299)$$

After this, the quantity of toner is measured based on the result of the correction (Step S57).

As described above, according to the fourth preferred embodiment, since the eccentric components E(x) of the roller are calculated (Step S46) and the sampling data D(X) obtained for measuring an actual quantity of toner are corrected using the eccentric components E(x) to thereby correct a change in sensing distance between the sensor 6 and the intermediate transfer belt 41 which is attributed to the eccentricity of the roller (Step S56), it is possible to suppress an influence of the eccentricity of the roller and improve the measuring accuracy.

In addition, since this embodiment suppresses a change in distance (sensing distance) between the sensor 6 and the intermediate transfer belt 41, it is possible to further improve the measuring accuracy as in the first preferred embodiment.

E. Fifth Preferred Embodiment

By the way, it is necessary to consider sampling intervals for more accurate measurement of a toner quantity, since when a belt cycle which an intermediate transfer belt 41 needs to run one round is a non-integer multiple of sampling intervals at which the CPU 11 samples the output voltages Vp and Vs, a phase difference is created between the rotation cycle of the intermediate transfer belt 41 and the sampling intervals.

When the belt cycle is an integer multiple of the sampling intervals, it is possible to measure a toner quantity at an excellent accuracy as described earlier even if the preferred embodiments above are executed as they are. Further, even when the belt cycle is a non-integer multiple of the sampling intervals, this is less influential if the phase difference is small to a negligible extent because of the short sampling intervals. However, for even more accurate measurement of a toner quantity by means of complete elimination of the phase difference, the eccentric components E(x) may be corrected an amount equivalent to the phase difference. A description will be now made on an application of the invention described above to an image forming apparatus in which the length of the circumference of the intermediate transfer belt 41 is a non-integer multiple of the length of the circumference of the sensor-facing roller 43 and the belt cycle is a non-integer multiple of the sampling intervals.

Figure 20:
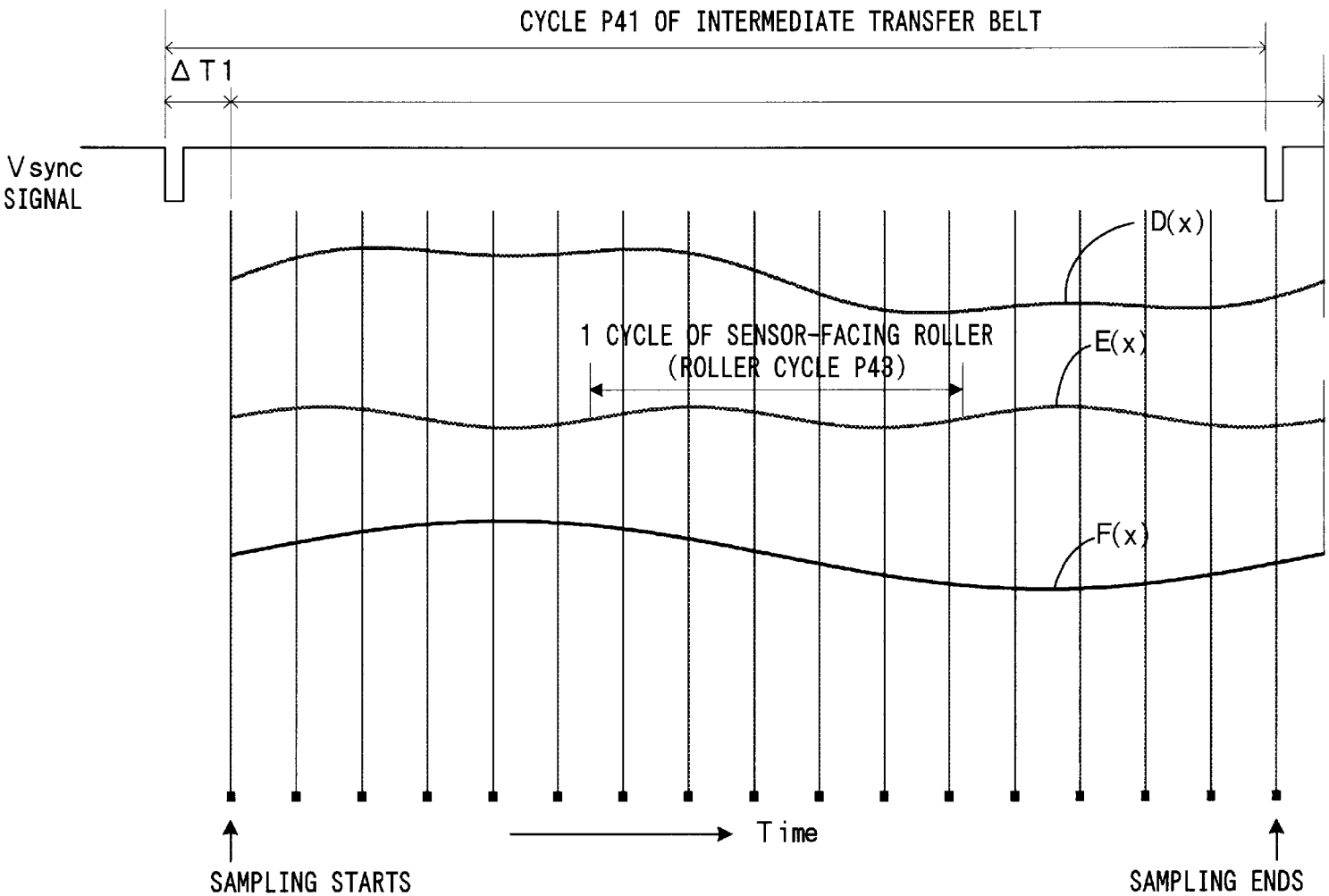
FIG. 20 is a graph showing sampling data corresponding an intermediate transfer belt without patch images, a profile of eccentric components of rollers and a periodic profile in a fifth preferred embodiment.

In an apparatus according to this embodiment, prior to measurement of a toner quantity, as shown in FIG. 20, as the predetermined period of time ΔT1 elapses since outputting of the vertical synchronizing signal Vsync from the sensor 40, sampling of the output voltages Vp and Vs is started. The output voltage Vp0 upon turning off is then subtracted from the output voltage Vp at each sampling position x, thereby calculating the light quantity signal SigP (=Vp−Vp0). In the meantime, the output voltage Vs0 upon turning off is subtracted from the output voltage Vs at each sampling position x, thereby calculating the light quantity signal SigS (=Vs−Vs0). The ratios of the light quantity signals (=SigP/SigS) are thereafter stored as the sampling data D(x) at the respective sampling positions x in a memory. Following this, in a manner similar to those in the preferred embodiments described earlier, the eccentric components E(x) and the periodic profile F(x) is calculated from this sampling data D(x).

Figure 21:
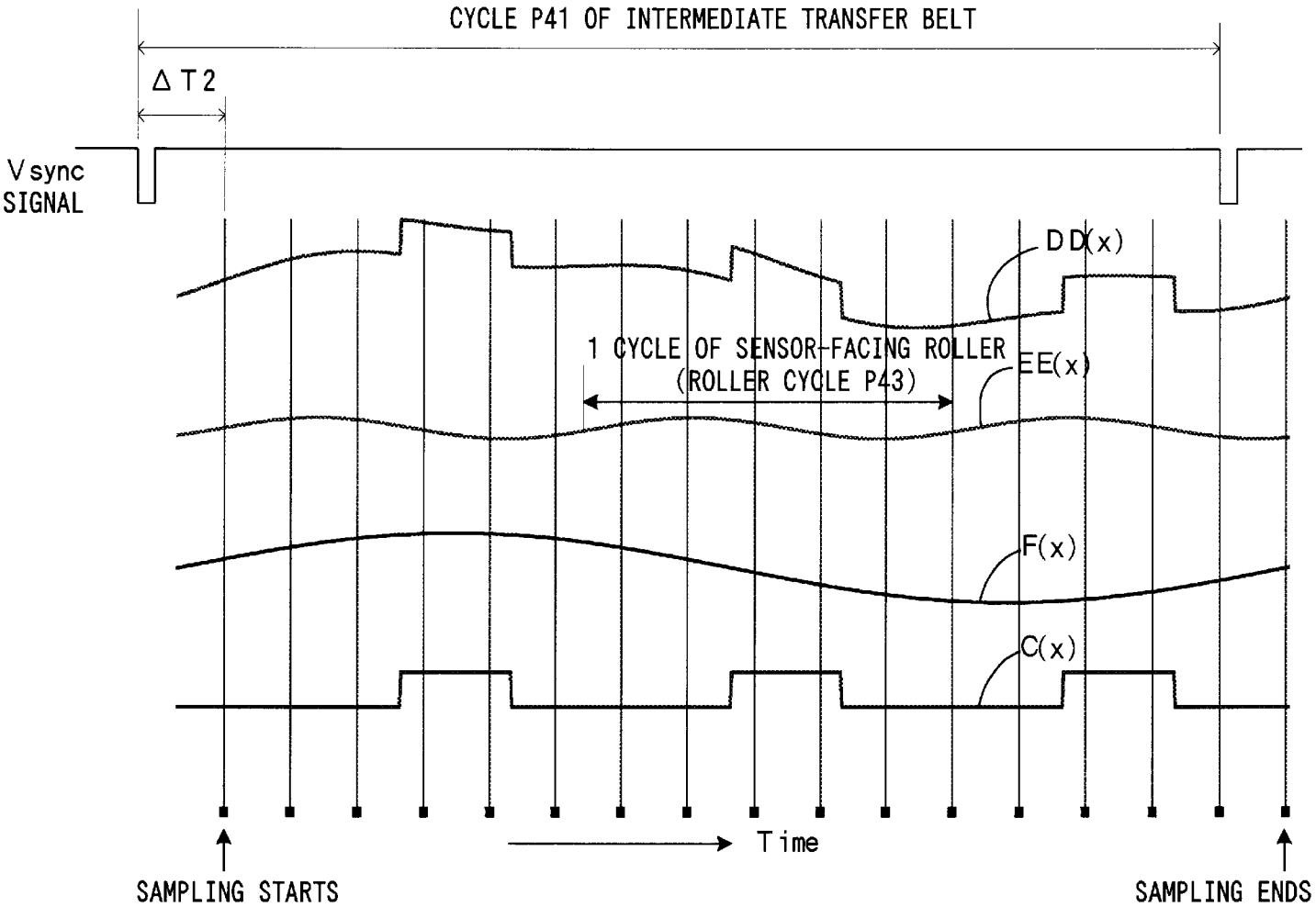
FIG. 21 is a graph showing sampling data corresponding the intermediate transfer belt with patch images, the profile of eccentric components of rollers, a periodic profile in a fifth preferred embodiment and a profile of a correction value.

For actual measurement of a toner quantity as well, as shown in FIG. 21, as the predetermined period of time elapses since outputting of the vertical synchronizing signal Vsync from the sensor 40, sampling of the output voltages Vp and Vs is started and sampling data DD(x) for measurement are obtained. However, since the belt cycle P41 is a non-integer multiple of the sampling intervals, sampling starts not after the predetermined period of time ΔT1 but after a period of time ΔT2 since outputting of the vertical synchronizing signal Vsync. In addition, the sensor-facing roller 43 is in different phases between upon calculation of the eccentric components E(x) and the periodic profile F(x) and upon detection for later calculation of a toner quantity. Thus, there are two types of displacement quantities in this embodiment.

In view of this, this embodiment requires to calculate these two types of displacement quantities in advance, and shift and correct the eccentric components E(x) calculated in the manner described above by these displacement quantities along the direction of time to thereby calculate the corrected eccentric components EE(x). This is followed by subtraction of eccentric components EE(x) and the periodic profile F(x) from the sampling data DD(x), whereby a correction value C(x) is calculated. A toner quantity is then measured based on the correction value C(x).

F. Others

The present invention is not limited to the preferred embodiments described above but may be modified in a variety of manners to the extent not departing from the spirit of the invention. For instance, although the sensor 6 is arranged to face the roller 43 in the preferred embodiments described above, the sensor 6 may be arranged to face the other rollers 42 and 44 to 47 around which the intermediate transfer belt 41 is stretched. However, since the roller 44 among the plurality of rollers 42 to 47 is a tension roller in the preferred embodiments described above, it is desirable that the sensor 6 is arranged to face one of these other rollers which are fixedly disposed to the main apparatus unit in advance so as to freely rotate at the fixed positions. This is because if the sensor 6 is arranged to face a roller which is fixedly disposed at a predetermined position for free rotation, a distance between this roller and the sensor 6 is constant.

On the other hand, since the tension roller 44 moves close to and away from the intermediate transfer belt 41, a distance between the sensor 6 and the tension roller 44 tends to change. This changes a distance between the sensor 6 and the area of the belt in which the belt rests on the tension roller 44, which is a cause of a deteriorated measurement accuracy. In order to prevent this, the tension roller 44 and the sensor 6 may be mechanically linked to each other so that as the tension roller 44 moves, the sensor 6 as well moves.

Further, although the preferred embodiments described above require to use the light quantity signal ratios (=SigP/SigS) which serve as an index regarding a toner quantity, other index value may be used such as the output voltages Vp and Vs, the light quantity signals SigP and SigS, the sum of the light quantity signals (=SigP+SigS) and a difference between the light quantity signals (=SigP−SigS).

Further, although the preferred embodiments described above use either (1) a structure that the sensor 6 is arranged facing the roller 43 to thereby suppress a change in sensing distance, (2) a structure that sampling data are corrected based on eccentric components of the roller, (3) a structure that sampling data are corrected based on a periodic profile (uneven thickness of the belt), or (4) a structure that sampling data are corrected based on a periodic profile (the condition of the surface of the belt), and eliminate influences of these factors to improve the accuracy of measuring the quantity of toner, it is needless to mention that the structures (1) through (4) may be used alone independently or appropriately combined with each other.

Further, although the light emitting element 601 and the light receiving elements 672*p* and 672*s* are arranged so that the surface of incidence receiving irradiated light and reflected light (the plane of FIG. 2) is approximately perpendicular to the axis of rotation of the sensor-facing roller 43 in the preferred embodiments described above as shown in FIG. 2, the relative arrangement of these elements is not limited to this. For example, the sensor 6 may be structured so that the surface of incidence mentioned above is approximately parallel to the axis of rotation of the roller. In addition, although the eccentricity of the roller changes the sensing distance and a change in angle of the roller surface (a surface of reflection) leads to a change in quantity of the reflected light if the surface of incidence is not parallel to the axis of rotation of the roller, with the surface of incidence positioned parallel to the axis of rotation of the roller, the angle of the surface of reflection becomes stable. Further, for the same reason, the surface of incidence and the axis of rotation of the roller may be arranged to be flush with each other for stabilizing the angle of the surface of reflection.

Further, although the present invention is applied to an image forming apparatus in which the intermediate transfer belt 41 is a belt-shaped image carrier according to the preferred embodiments described above, applications of the present invention are not limited to this. The present invention is also applied to an image forming apparatus in which a toner image is formed on a photosensitive belt. The present invention is generally applicable to image forming apparatuses which comprise a belt-shaped image carrier which is stretched across a plurality of rollers.

Further, although the preferred embodiments described above relate to an image forming apparatus which creates a color image using four toner colors, applications of the present invention are not limited to this. It is needless to mention that the present invention is applicable to an image forming apparatus which forms only a monochrome image. In addition, while the image forming apparatuses according to the preferred embodiments described above are printers which create an image supplied from an external apparatus, such as a host computer, on a sheet S such as a transfer paper, a copier paper and a transparency for an overhead projector, the present invention is generally applicable to image forming apparatuses of the electrophotographic type such as a copier machine and a facsimile machine.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A toner quantity measuring apparatus for measuring the quantity of toner adhering to a belt-shaped image carrier which is stretched across a plurality of rollers, comprising:

a sensor, including a light emitting element for irradiating light upon said belt-shaped image carrier, which receives light reflected by said belt-shaped image carrier and outputs a signal which corresponds to the quantity of the received light; and toner quantity deriving means which calculates the quantity of the toner adhering to said belt-shaped image carrier based on the output from said sensor, wherein said light emitting element is positioned to face one of said plurality of rollers across said belt-shaped image carrier, and irradiates light upon a wind area, out of a surface area of said belt-shaped image carrier, in which said belt-shaped image carrier rests on a sensor-facing roller which is positioned to face said light emitting element, wherein said belt-shaped image carrier rotates one round while said sensor-facing roller rotates two or more rounds, wherein said toner quantity deriving means samples the output from said sensor at predetermined sampling intervals while said belt-shaped image carrier rotates at least one round and calculates eccentric components of said rollers based on sampling output before forming a toner image, and wherein for calculation of the image density of said toner image on said belt-shaped image carrier, using said eccentric components, said toner quantity driving means corrects the output from said sensor which receives light reflected by said belt-shaped image carrier and calculates the image density of said toner image based on a correction value.

2. A toner quantity measuring apparatus in accordance with claim 1, wherein a belt cycle which said belt-shaped image carrier needs to run one round is an integer multiple of the sampling intervals.

3. A toner quantity measuring apparatus in accordance with claim 2, wherein the length of the circumference of said belt-shaped image carrier is a non-integer multiple of the length of the circumference of said sensor-facing roller, wherein said toner quantity deriving means subtracts said eccentric components from said sampling output to obtain a periodic profile of said belt-shaped image carrier before forming said toner image, and wherein for calculation of the image density of said toner image on said belt-shaped image carrier, using said eccentric components and said periodic profile, said toner quantity deriving means corrects the output from said sensor which receives light reflected by said belt-shaped image carrier and calculates the image density of said toner image based on a correction value.

4. A toner quantity measuring apparatus in accordance with claim 1, wherein a belt cycle which said belt-shaped image carrier needs to run one round is a non-integer multiple of the sampling intervals whereby a phase difference is created between a rotation cycle of said belt-shaped image carrier and the sampling intervals, wherein said toner quantity deriving means shifts said eccentric components by these displacement quantities along a direction of time to thereby correct said eccentric components before forming said toner image, and wherein for calculation of the image density of said toner image on said belt-shaped image carrier, using said corrected eccentric components, said toner quantity deriving means corrects the output from said sensor which receives light reflected by said belt-shaped image carrier and calculates the image density of said toner image based on a correction value.

5. A toner quantity measuring apparatus in accordance with claim 4, wherein the length of the circumference of said belt-shaped image carrier is a non-integer multiple of the length of the circumference of said sensor-facing roller, wherein said toner quantity deriving means subtracts said eccentric components from said sampling output to obtain a periodic profile of said belt-shaped image carrier before forming said toner image, and wherein for calculation of the image density of said toner image on said belt-shaped image carrier, using said corrected eccentric components and said periodic profile, said toner quantity deriving means corrects the output from said sensor which receives light reflected by said belt-shaped image carrier and calculates the image density of said toner image based on a correction value.

6. A toner quantity measuring apparatus in accordance with claim 1, wherein the length of the circumference of said belt-shaped image carrier is an integer multiple of the length of the circumference of said sensor-facing roller.

7. The toner quantity measuring apparatus according to claim 1, wherein said sensor-facing roller is fixedly arranged at a predetermined position and capable of freely rotating at said predetermined position.

8. A toner quantity measuring apparatus for measuring the quantity of toner adhering to a belt-shaped image carrier which is stretched across a plurality of rollers, comprising:

a sensor, including a light emitting element for irradiating light upon said belt-shaped image carrier, which receives light reflected by said belt-shaped image carrier and outputs a signal which corresponds to the quantity of the received light; and toner quantity deriving means which calculates the quantity of the toner adhering to said belt-shaped image carrier based on the output from said sensor, wherein said light emitting element is positioned to face one of said plurality of rollers across said belt-shaped image carrier, and irradiates light upon a wind area, out of a surface of said belt-shaped image carrier, in which said belt-shaped image carrier rests on a sensor-facing roller which is positioned to face said light emitting element, and wherein said sensor is arranged above a horizontal opposing position which is at an opposite side of said sensor-facing roller with respect to a horizontal direction.

9. A toner quantity measuring apparatus for measuring the quantity of toner adhering to a belt-shaped image carrier which is stretched across a plurality of rollers, comprising:

a sensor, including a light emitting element for irradiating light upon said belt-shaped image carrier, which receives light reflected by said belt-shaped image carrier and outputs a signal which corresponds to the quantity of the received light; and toner quantity deriving means which calculates the quantity of the toner adhering to said belt-shaped image carrier based on the output from said sensor, wherein said toner quantity deriving means samples an output signal from said sensor at predetermined sampling intervals while said belt-shaped image carrier rotates and travels, calculates eccentric components of said rollers based on a sampling output, removes said eccentric components from said sampling output and accordingly calculates a periodic profile which is indicative of the condition of a surface of said belt-shaped image carrier before forming a toner image, and wherein for calculation of the image density of said toner image on said belt-shaped image carrier, using said eccentric components and said periodic profile, said toner quantity deriving means corrects the output from said light receiving element which receives light reflected by said belt-shaped image carrier and calculates the image density of said toner image based on a correction value.

10. A toner quantity measuring apparatus in accordance with claim 9, wherein a belt cycle which said belt-shaped image carrier needs to run one round is an integer multiple of the sampling intervals.

11. A toner quantity measuring apparatus in accordance with claim 9, wherein a belt cycle which said belt-shaped image carrier needs to run one round is a non-integer multiple of the sampling intervals whereby a phase difference is created between a rotation cycle of said belt-shaped image carrier and the sampling intervals, wherein said toner quantity deriving means shifts said eccentric components by these displacement quantities along a direction of time to thereby correct said eccentric components before forming said toner image, and wherein for calculation of the image density of said toner image on said belt-shaped image carrier, using said corrected eccentric components and said periodic profile, said toner quantity deriving means corrects the output from said sensor which receives light reflected by said belt-shaped image carrier and calculates the image density of said toner image based on a correction value.

12. An image forming apparatus, comprising:

a belt-shaped image carrier which is stretched across a plurality of rollers;

a toner quantity measuring apparatus in accordance with claim 9; and control means which adjusts a process condition based on a toner quantity which is measured by said toner quantity measuring apparatus and accordingly controls the density of a toner image which is formed on said belt-shaped image carrier.

13. A toner quantity measuring apparatus for measuring the quantity of toner adhering to a belt-shaped image carrier which is stretched across a plurality of rollers, comprising:

a sensor, including a light emitting element for irradiating light upon said belt-shaped image carrier, which receives light reflected by said belt-shaped image carrier and outputs a signal which corresponds to the quantity of the received light; and toner quantity deriving means which calculates the quantity of the toner adhering to said belt-shaped image carrier based on the output from said sensor, wherein the length of the circumference of said belt-shaped image carrier is an integer multiple of the length of the circumference of one of said rollers, and said belt-shaped image carrier rotates one round while said one of said rollers rotates two or more rounds, and wherein said toner quantity deriving means samples the output signal from said sensor at predetermined sampling intervals while said belt-shaped image carrier rotates and travels and calculates eccentric components of said rollers based on a sampling output before forming a toner image, and wherein for calculation of the image density of said toner image on said belt-shaped image carrier, using said eccentric components, said toner quantity deriving means corrects the output from said sensor which receives light reflected by said belt-shaped image carrier and calculates the image density of said toner image based on a correction value.

14. A toner quantity measuring apparatus in accordance with claim 13, wherein a belt cycle which said belt-shaped image carrier needs to run one round is an integer multiple of the sampling intervals.

15. A toner quantity measuring apparatus in accordance with claim 13, wherein a belt cycle which said belt-shaped image carrier needs to run one round is a non-integer multiple of the sampling intervals whereby a phase difference is created between a rotation cycle of said belt-shaped image carrier and the sampling intervals, wherein said toner quantity deriving means shifts said eccentric components by these displacement quantities along a direction of time to thereby correct said eccentric components before forming said toner image, and wherein for calculation of the image density of said toner image on said belt-shaped image carrier, using said corrected eccentric components, said toner quantity deriving means corrects the output from said sensor which receives light reflected by said belt-shaped image carrier and calculates the image density of said toner image based on a correction value.

16. An image forming apparatus, comprising:

a belt-shaped image carrier which is stretched across a plurality of rollers;

a toner quantity measuring apparatus in accordance with claim 13; and control means which adjusts a process condition based on a toner quantity which is measured by said toner quantity measuring apparatus and accordingly controls the density of a toner image which is formed on said belt-shaped image carrier.

17. A surface condition detecting method of detecting the condition of a surface of a belt-shaped image carrier which is stretched across a plurality of rollers, one of said plurality of rollers being a driving roller, said method comprising:

a first step of irradiating light from a light emitting element upon said belt-shaped image carrier which is rotating and traveling, and sampling an output signal from a light receiving element which receives light reflected by said belt-shaped image carrier at predetermined sampling intervals to thereby obtain a sampling output;

a second step of calculating eccentric components of said driving roller from said sampling output; and a third step of removing said eccentric components from said sampling output and calculating periodic profile which is indicative of the condition of a surface of said belt-shaped image carrier.

18. A surface condition detecting method in accordance with claim 17, wherein at said first step, said light emitting element, which is positioned to face one of said plurality of rollers across said belt-shaped image carrier, irradiates light upon a wind area, out of a surface area of said belt-shaped image carrier, in which said belt-shaped image carrier rests on said sensor-facing roller.

19. A surface condition detecting method in accordance with claim 17, wherein the sampling intervals is set so that a belt cycle which said belt-shaped image carrier needs to run one round is an integer multiple of the sampling intervals.

20. A surface condition detecting method in accordance with claim 17, wherein the sampling intervals is set so that a belt cycle which said belt-shaped image carrier needs to run one round is a non-integer multiple of the sampling intervals whereby a phase difference is created between a rotation cycle of said belt-shaped image carrier and the sampling intervals, and wherein at said second step, said eccentric components is shifted by these displacement quantities along a direction of time whereby said eccentric components is corrected.

21. A toner quantity measuring method for measuring the quantity of toner adhering to a belt-shaped image carrier which is stretched across a plurality of rollers, one of said plurality of rollers being a driving roller, said method comprising:

a preparation step of obtaining eccentric components of said driving roller and a periodic profile which is indicative of the condition of the surface of said belt-shaped image carrier;

a sampling step of irradiating light from a light emitting element upon said belt-shaped image carrier on which a toner image is formed, and sampling an output signal from a light receiving element which receives light reflected by said belt-shaped image carrier at predetermined sampling intervals to thereby obtain a sampling output; and a measuring step of correcting said sampling output obtained at said sampling step using said eccentric components and said periodic profile and calculating the image density of said toner image based on a correction value.

22. A toner quantity measuring method in accordance with claim 21, wherein the sampling intervals is set so that a belt cycle which said belt-shaped image carrier needs to run one round is an integer multiple of the sampling intervals.

23. A toner quantity measuring method in accordance with claim 21, wherein the sampling intervals is set so that a belt cycle which said belt-shaped image carrier needs to run one round is a non-integer multiple of the sampling intervals whereby a phase difference is created between a rotation cycle of said belt-shaped image carrier and the sampling intervals, wherein at said preparation step, said eccentric components is shifted by these displacement quantities along a direction of time whereby said eccentric components is corrected.

24. A toner quantity measuring apparatus for measuring a quantity of toner adhering to a belt-shaped image carrier which is stretched across a plurality of rollers, comprising:

a sensor, including a light emitting element for irradiating light upon said belt-shaped image carrier, which receives light reflected by said belt-shaped image carrier and outputs a signal which corresponds to a quantity of the received light; and toner quantity deriving means which calculates the quantity of the toner adhering to said belt-shaped image carrier based on the output signal from said sensor, wherein said toner quantity deriving means samples the output signal from said sensor at predetermined sampling intervals while said belt-shaped image carrier rotates and travels, and calculates eccentric components of said plurality of rollers based on a sampling output, and wherein for calculation of an image density of said toner image on said belt-shaped image carrier, using said eccentric components, said toner quantity deriving means corrects the output signal from said light receiving element which receives light reflected by said belt-shaped image carrier and calculates the image density of said toner image based on a correction value.

25. A toner quantity measuring apparatus for measuring a quantity of toner adhering to a belt-shaped image carrier which is stretched across a plurality of rollers, comprising:

a sensor, including a light emitting element for irradiating light upon said belt-shaped image carrier, which receives light reflected by said bell-shaped image carrier and outputs a signal which corresponds to a quantity of the received light; and toner quantity deriving means which calculates the quantity of the toner adhering to said belt-shaped image carrier based on the output signal from said sensor, wherein said toner quantity deriving means samples the output signal from said sensor at predetermined sampling intervals while said belt-shaped image carrier travels, and accordingly calculates a profile which is indicative of the condition of a surface of said belt-shaped image carrier before forming a toner image, and wherein for calculation of an image density of said toner image on said belt-shaped image carrier, using said profile, said toner quantity deriving means corrects the output signal from said light receiving element which receives light reflected by said belt-shaped image carrier and calculates the image density of said toner image based on a correction value.

* * * * *